US012075885B2

(12) United States Patent
Meir et al.

(10) Patent No.: US 12,075,885 B2
(45) Date of Patent: Sep. 3, 2024

(54) ARTICLE OF FOOTWEAR INCORPORATING A FOREFOOT TOE WRAP

(71) Applicant: NIKE, Inc., Beaverton, OR (US)

(72) Inventors: Adrian Meir, Portland, OR (US); James Molyneux, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/405,564

(22) Filed: Aug. 18, 2021

(65) Prior Publication Data

US 2021/0378361 A1 Dec. 9, 2021

Related U.S. Application Data

(62) Division of application No. 14/984,967, filed on Dec. 30, 2015, now Pat. No. 11,122,863.

(60) Provisional application No. 62/104,355, filed on Jan. 16, 2015.

(51) Int. Cl.

| | |
|---|---|
| ***A43B 23/02*** | (2006.01) |
| ***A43B 1/04*** | (2022.01) |
| ***A43B 7/14*** | (2022.01) |
| ***A43B 23/04*** | (2006.01) |

(52) U.S. Cl.

CPC ..... *A43B 23/0245* (2013.01); *A43B 1/04* (2013.01); *A43B 7/1495* (2013.01); *A43B 23/042* (2013.01)

(58) Field of Classification Search

CPC ... A43B 23/042; A43B 23/0245; A43B 23/02; A43B 23/25; A43B 3/106; A43B 7/1495; A43B 7/18; A43B 7/22; A43B 3/126

See application file for complete search history.

(56) References Cited

U.S. PATENT DOCUMENTS

| | | | | |
|---|---|---|---|---|
| 2,798,309 | A * | 7/1957 | Wustemann | A43B 7/1495 602/66 |
| 4,114,297 | A * | 9/1978 | Famolare, Jr. | A43C 11/008 36/129 |
| 4,441,265 | A | 4/1984 | Burns et al. | |
| 4,550,511 | A * | 11/1985 | Gamm | A43B 7/1495 36/91 |
| 4,756,098 | A * | 7/1988 | Boggia | A43B 5/00 36/114 |
| 4,901,451 | A * | 2/1990 | Cumin | A43C 11/008 36/170 |

(Continued)

FOREIGN PATENT DOCUMENTS

| | | | |
|---|---|---|---|
| CA | 2907601 | A1 | 9/2014 |
| CN | 102271548 | A | 12/2011 |

(Continued)

OTHER PUBLICATIONS

Intention to Grant received for European Patent Application No. 19168215.2, mailed on Jul. 6, 2022, 7 pages.

*Primary Examiner* — Megan E Lynch

(74) *Attorney, Agent, or Firm* — Shook, Hardy & Bacon L.L.P.

(57) ABSTRACT

An article of footwear may include an upper having an extended portion. The extended portion extends from a first side of the upper. The extended portion may pass below the upper of the article of footwear to the second side. The extended portion may be secured in multiple positions to adjust the fit of an article of footwear. The extended portion may incorporate a tensile element.

18 Claims, 21 Drawing Sheets

(56) References Cited

U.S. PATENT DOCUMENTS 5,604,997 A * 2/1997 Dieter ..... A43B 23/042 36/47
5,704,140 A * 1/1998 Fields ..... A43B 7/1495 36/132
8,490,299 B2 7/2013 Dua et al.
8,839,532 B2 9/2014 Huffa et al.
2005/0193592 A1* 9/2005 Dua ..... A43D 8/00 36/45
2006/0117606 A1* 6/2006 Chen ..... A43B 7/223 36/91
2008/0110049 A1* 5/2008 Sokolowski ..... A43C 1/04 36/50.1
2009/0090027 A1* 4/2009 Baudouin ..... A43B 7/1495 602/23
2009/0277043 A1* 11/2009 Graser ..... A43B 7/1495 36/91
2010/0037483 A1* 2/2010 Meschter ..... A43B 3/26 36/47
2010/0325916 A1* 12/2010 Dua ..... A43B 23/0215 36/47
2011/0010965 A1* 1/2011 Shepherd ..... A43B 7/20 36/114
2011/0277349 A1* 11/2011 Kim ..... A43B 23/042 12/146 C
2012/0011744 A1* 1/2012 Bell ..... A43B 23/0245 36/91
2012/0079741 A1* 4/2012 Kohatsu ..... A43B 23/0245 36/50.1
2013/0104423 A1* 5/2013 Hatfield ..... A43B 23/0235 36/103
2013/0160328 A1* 6/2013 Hatfield ..... A43B 7/20 36/103
2013/0192091 A1* 8/2013 Kohatsu ..... A43B 3/26 36/103
2013/0255105 A1* 10/2013 Bishop ..... A43B 7/28 36/25 R
2013/0269212 A1* 10/2013 Little ..... D04B 21/207 12/146 C
2013/0318822 A1* 12/2013 Wang ..... A43B 23/042 36/83
2014/0173938 A1* 6/2014 Beye ..... A43B 13/125 36/102
2014/0196316 A1 7/2014 Follet
2014/0245545 A1 9/2014 Meir et al.
2014/0245634 A1* 9/2014 Podhajny ..... A43B 1/04 66/170
2014/0259738 A1* 9/2014 Yen ..... A43B 3/122 36/11.5
2014/0310987 A1* 10/2014 Sokolowski ..... A43B 23/0235 36/84
2015/0068061 A1* 3/2015 Farris ..... A43B 23/08 36/83
2015/0143720 A1* 5/2015 Avar ..... A43B 1/04 36/107
2016/0198798 A1* 7/2016 Ikenaka ..... D04B 1/22 66/170
2016/0206045 A1 7/2016 Meir et al.

FOREIGN PATENT DOCUMENTS

EP 0061971 A1 10/1982
EP 0063326 A1 10/1982
EP 1716773 A1 11/2006
EP 3011854 A1 4/2016
EP 3037012 A1 6/2016
JP S10000785 B 1/1935
JP 2010508968 A 3/2010
JP 2012512698 A 6/2012
TW 200517246 A 6/2005
TW 201026246 A 7/2010
WO 9004933 A1 5/1990
WO 2008063385 A1 5/2008
WO 2010080182 A1 7/2010
WO 2014137825 A1 9/2014
WO 2014147765 A1 9/2014
WO 2014203584 A1 12/2014
WO 2014209596 A1 12/2014
WO 2015025678 A1 2/2015

* cited by examiner

ARTICLE OF FOOTWEAR INCORPORATING A FOREFOOT TOE WRAP

CROSS-REFERENCE TO RELATED APPLICATIONS

This application is a divisional of U.S. application Ser. No. 14/984,967, filed Dec. 30, 2015, which claims the benefit of U.S. Provisional Application No. 62/104,355, filed Jan. 16, 2015, the entireties of which are incorporated by reference.

BACKGROUND

Conventional articles of footwear generally include two primary elements, an upper and a sole structure. The upper and the sole structure, at least in part, define a foot-receiving chamber that may be accessed by a user's foot through a foot-receiving opening.

The upper is secured to the sole structure and forms a void on the interior of the footwear for receiving a foot in a comfortable and secure manner. The upper member may secure the foot with respect to the sole member. The upper may extend around the ankle, over the instep and toe areas of the foot. The upper may also extend along the medial and lateral sides of the foot as well as the heel of the foot. The upper may be configured to protect the foot and provide ventilation, thereby cooling the foot. Further, the upper may include additional material to provide extra support in certain areas.

The sole structure is secured to a lower area of the upper, thereby positioned between the upper and the ground. The sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

A variety of material elements (e.g. textiles, polymer foam, polymer sheets, leather, synthetic leather) are conventionally utilized in manufacturing the upper. In athletic footwear, for example, the upper may have multiple layers that each includes a variety of joined material elements. As examples, the material elements may be selected to impart stretch-resistance, wear resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas.

As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and number of material elements. Further, multiple pieces that are stitched together may cause a greater concentration of forces in certain areas. The stitch junctions may transfer stress at an uneven rate relative to other parts of the article of footwear which may cause failure or discomfort. Additional material and stitch joints may lead to discomfort when worn. By decreasing the number of material elements utilized in the upper, therefore, waste may be decreased while increasing the manufacturing efficiency, the comfort, performance, and the recyclability of the upper.

SUMMARY

In one aspect, an article of footwear includes an upper and a sole structure secured to the upper. The upper includes a base portion and an extended portion. The base portion has a first side and a second side. The extended portion extends from the first side. The extended portion passes below the upper from the first side to the second side. The extended portion extends beyond the second side.

In another aspect, an article of footwear includes an upper and a sole structure secured to the upper. The upper incorporates a knitted component. The knitted component includes a base portion and an extended portion. The base portion having a first side and a second side. The extended portion extending from the first side. The extended portion passing below the knitted component from the first side to the second side. The extended portion extending beyond the second side.

In another aspect, an article of footwear includes an upper and a sole structure secured to the upper. The upper incorporates a knitted component. The knitted component includes a base portion and an extended portion. The base portion has a first side and a second side. The extended portion extends from the first side. The extended portion passes below the knitted component from the first side to the second side. The extended portion incorporates a tensile element. The tensile element extends to a throat area of the upper.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the Figures are not necessarily to scale, emphasis instead being placed upon illustrating the principles of the embodiments. Moreover, in the Figures, like reference numerals designate corresponding parts throughout the different views.

The foregoing Summary and the following Detailed Description will be better understood when read in conjunction with the accompanying Figures.

DETAILED DESCRIPTION

For clarity, the detailed descriptions herein describe certain exemplary embodiments, but the disclosure herein may be applied to any article of footwear comprising certain features described herein and recited in the claims. In particular, although the following Detailed Description discusses exemplary embodiments in the form of footwear such as running shoes, jogging shoes, tennis, squash or racquetball shoes, basketball shoes, sandals and flippers, the disclosures herein may be applied to a wide range of footwear or possibly other kinds of articles.

For consistency and convenience, directional adjectives are employed throughout this Detailed Description corresponding to the illustrated embodiments. The term "longitudinal direction" as used throughout this detailed description and in the claims refers to a direction extending from heel to toe, which may be associated with the length, or longest dimension, of an article of footwear such as a sports or recreational shoe. Also, the term "lateral direction" as used throughout this Detailed Description and in the claims refers to a direction extending from side to side (lateral side and medial side) or the width of an article of footwear. The lateral direction may generally be perpendicular to the longitudinal direction. The term "vertical direction" as used with respect to an article of footwear throughout this Detailed Description and in the claims refers to the direction that is normal to the plane of the sole of the article of footwear. Moreover, the vertical direction may generally be perpendicular to both the longitudinal direction and the lateral direction.

The term "sole" as used herein shall refer to any combination that provides support for a wearer's foot and bears the surface that is in direct contact with the ground or playing surface, such as a single sole; a combination of an outsole and an inner sole; a combination of an outsole, a midsole and an inner sole, and a combination of an outer covering, an outsole, a midsole and an inner sole.

In the various figures and depictions, the article and components of the article are formed to accommodate a left foot. It should be recognized, however, that the same general structure may be formed to accommodate a right foot.

FIGS. 1-5 illustrate various views of upper component 100 as well as article of footwear 400, also referred to simply as article 400. Upper component 100 may largely or substantially form an upper of an article of footwear; however other components or elements may be attached or inserted to make the upper. For example, an upper may include laces, graphics, a tongue, support mechanisms, and other additional features.

Figure 4:
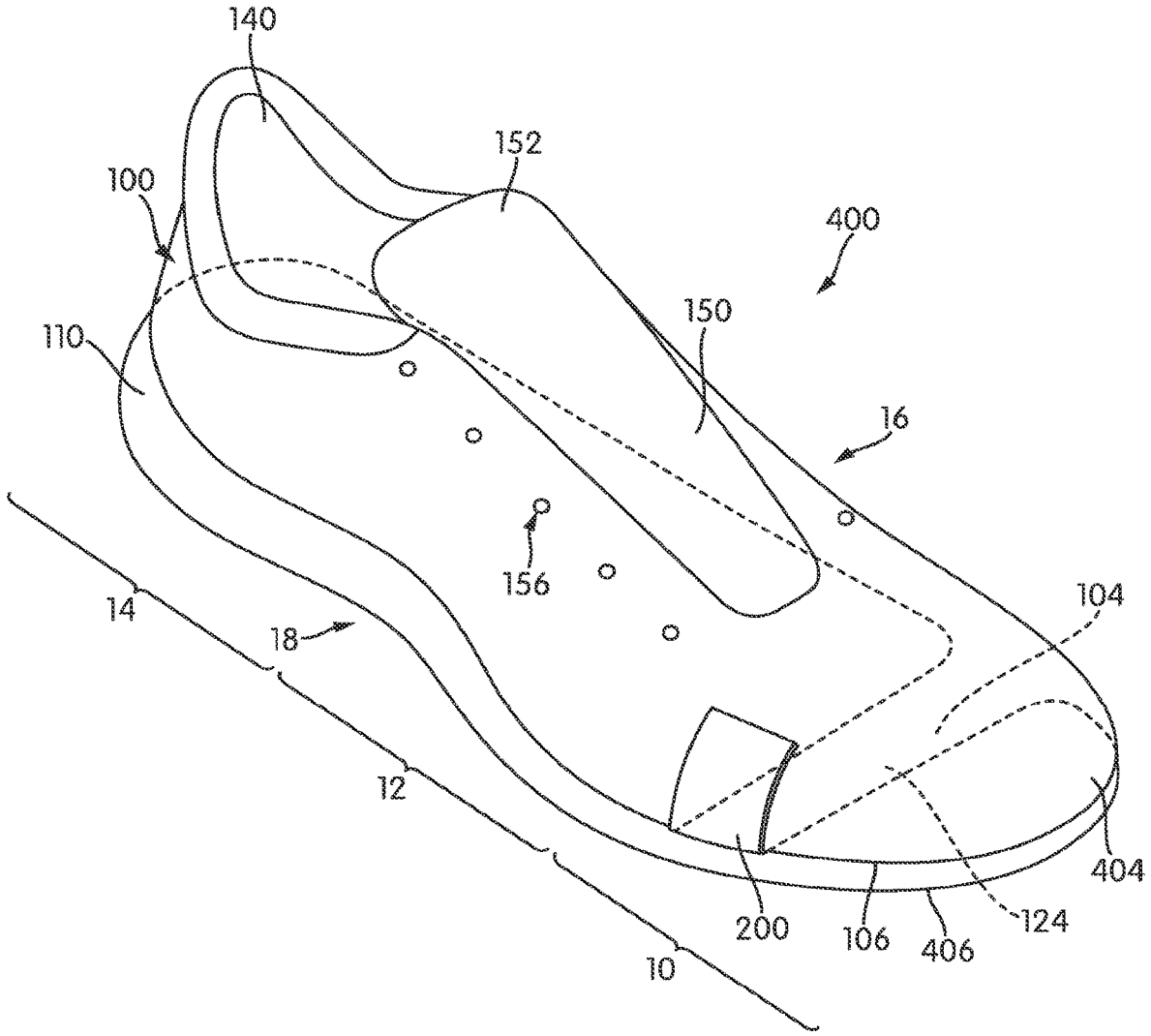
FIG. 4 is an isometric view of an exemplary embodiment of an article of footwear.
Figure 5:
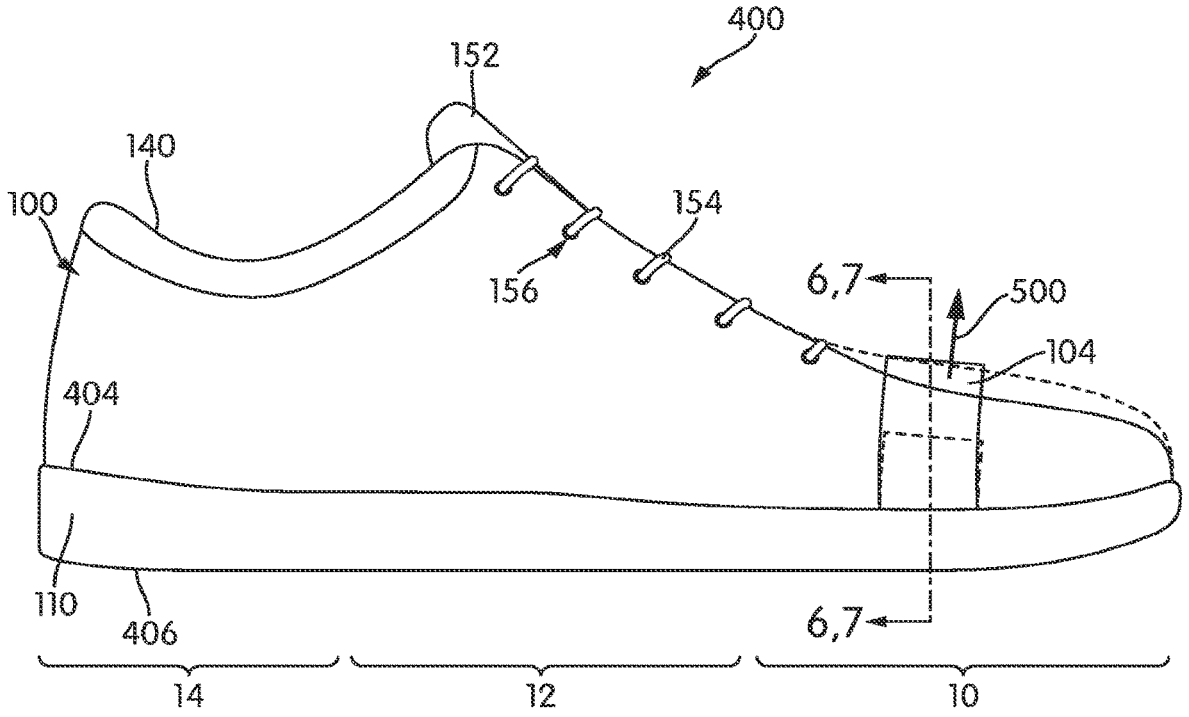
FIG. 5 is an side view of an exemplary embodiment of an article of footwear being subjected to a tensile force.

As best shown in FIGS. 4 and 5, article 400 may be divided into three general regions: a forefoot region 10, a midfoot region 12, and a heel region 14. The general regions may be applied to article 400, as well as other components of article 400 including upper component 100, sole structure 110, and individual elements thereof. Forefoot region 10 generally includes portions of article 400 that correspond with the toes and the joints connecting the metatarsals with the phalanges. Midfoot region 12 generally includes portions of article 400 corresponding with an arch area of the foot. Heel region 14 generally corresponds with rear portions of the foot, including the calcaneus bone.

Article 400 also includes a lateral side 16 and a medial side 18, which extend through forefoot region 10, midfoot region 12, and heel region 14, and correspond with opposite sides of footwear. More particularly, lateral side 16 corresponds with an outside area of the foot, and medial side 18 corresponds with an inside area of the foot (i.e., the surface that faces toward the other foot). Forefoot region 10, midfoot region 12, heel region 14, lateral side 16, and medial side 18 are not intended to demarcate precise areas of footwear. Rather, forefoot region 10, midfoot region 12, heel region 14, lateral side 16, and medial side 18 are intended to represent general areas of article 400 to aid in the following discussion.

In some embodiments, a lace 154 may extend through a plurality of lace apertures 156 in upper component 100 which may permit the wearer to modify the dimensions of upper component 100 to accommodate proportions of the foot (shown in FIG. 5). More particularly, lace 154 permits the wear to tighten upper component 100 around the foot, and lace 154 permits the wearer to loosen upper component 100 to facilitate entry and removal of the foot from the void (i.e. through throat opening 140). In addition, a tongue 152 extends through instep area 150 from a forward portion of upper component 100 in forefoot region 10 to a top portion of upper component 100 adjacent to throat opening 140 in heel region 14. In this embodiment, tongue 152 extends under lace 154 to enhance the comfort of article 400. In addition to, or in alternative of lace apertures 156, upper component 100 may include other lace-receiving elements, such as b-rings, hooks, or various looped tensile elements. In further configurations, upper component 100 may include additional elements, such as (a) a heel counter in heel region 14 that enhances stability, (b) a toe guard in forefoot region 10 that is formed of a wear-resistant material, and (c) logos, trademarks, and placards with care instructions and material information.

In some embodiments, additional provisions for adjusting the shape of the upper component may be included. In particular, in some embodiments, the fit of the upper component may be adjustable in the forefoot region. In some embodiments, an extended portion may be used to adjust the fit of an article of footwear. In some embodiments, the extended portion of the upper component may wrap under the upper component of a formed article of footwear. The extended portion may be tensioned thereby changing the fit and feel of the article in the forefoot region. Aspects of the extended portion and additional features are discussed in further detail below.

Figure 1:
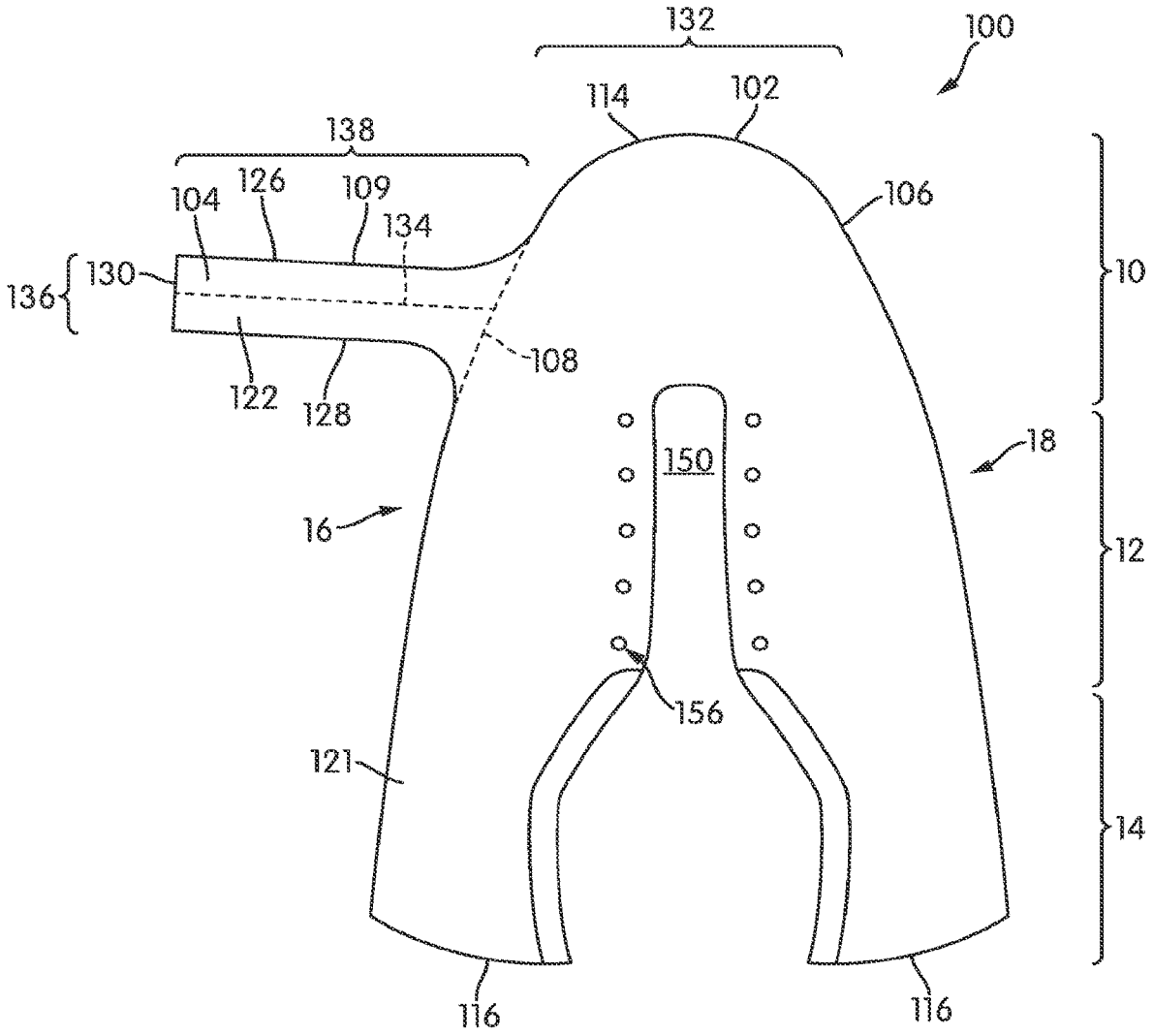
FIG. 1 is a top view of an exemplary embodiment of an upper component.

Referring to FIG. 1, a two dimensional representation of upper component 100 is depicted. In some embodiments, upper component 100 may include a base portion 102 and an extended portion 104. As shown in FIG. 1 outer surface 121 of base portion 102 and first surface 122 of extended portion 104 may be located along a substantially similar plane. Base portion 102 may be defined by a majority of perimeter edge 106 as well as by continuation edge 108. Perimeter edge 106 extends substantially around the periphery of base portion 102 of upper component 100. Perimeter edge 106 extends from toe edge 114 in forefoot region 10 toward heel edges 116 in heel region 14. Perimeter edge 106 may be curved in forefoot region 10 in order to accommodate toes of a user in a completed article. Additionally, perimeter edge 106 extends from heel edges 116 inward toward instep area 150 thereby defining the shape of instep area 150. As perimeter edge 106 extends along lateral side 16 or medial side 18, perimeter edge may abut extended portion 104. In some embodiments, extended portion 104 may be formed in forefoot region 14. That is, the edges of extended portion 104 may be considered different edges than perimeter edge 106. Perimeter edge 106 therefore may include a gap in the area in which extended portion 104 and base portion 102 coincide. Continuation edge 108 may span the gap in perimeter edge 106 in the area of extended portion 104. Continuation edge 108 may therefore complete the shape of base portion 102. Although continuation edge 108 may be used in reference to the shape and dimensions of base portion 102 and extended portion 104, it should be recognized that continuation edge 108 is used as a reference. For example, in some embodiments there may not be delineation between extended portion 104 and base portion 102 along continuation edge 108. For example, extended portion 104 and base portion 102 may be formed in a one-piece configuration. In such embodiments, continuation edge 108 may not be a visible edge; rather, continuation edge 108 may be used in discussion to refer to different portions of upper component 100.

In some embodiments an extended portion may be formed along lateral side 16 of upper component 100. In some embodiments, an extended portion may be largely rectangular in shape. In other embodiments, an extended portion may have other shapes. Extended portion 104 as depicted extends from lateral side 16 away from base portion 102. Additionally, as depicted, extended portion 104 extends substantially perpendicular to the longitudinal direction, or heel to toe direction. As shown, extended portion 104 extends away from base portion 102 substantially perpendicular to the longitudinal direction. In other embodiments, extended portion 104 may extend away from a side at other angles or orientations. Extended portion 104 may be defined by extended portion edge 109 as well as by continuation edge 108. Extended portion edge 109 extends substantially around the periphery of extended portion 104. Continuation edge 108 may represent a boundary between extended portion 104 and base portion 102. Continuation edge 108 is not meant to be a precise demarcation between extended portion 104 and base portion 102; rather, continuation edge 108 is used to illustrate the general region between extended portion 104 and base portion 102 as well as to aid in the discussion of extended portion 104 and base portion 102. Extended portion edge 109 and continuation edge 108 combine to form the shape of extended portion 104. As shown, extended portion 104 has a largely rectangular shape.

In some embodiments, toe edge 114 may be located within forefoot region 10. In some embodiments, toe edge 114 may indicate the edge area that is furthest from heel region 14 and is disposed at the front of the article of footwear. Additionally, in some embodiments, heel edges 116 may be located within heel region 14. In some embodiments, heel edges 116 may indicate the edge area that is furthest from forefoot region 10 and is disposed at the rear of the article of footwear. As such, in some embodiments, toe edge 114 and heel edges 116 may be located on opposite ends of upper component 100 along the longitudinal direction, or the length of upper component 100.

In some embodiments, extended portion edge 109 may be divided into multiple edges in order to aid in discussion of extended portion 104. Extended edge portion 109 of extended portion 104 may include an upper edge 126, a lower edge 128, and a grasping edge 130. Upper edge 126 may refer to the edge of extended portion 104 that is located toward toe edge 114. Lower edge 128 may refer to the edge of extended portion 104 that is located toward to heel edges 116. Additionally, grasping edge 130 may extend between upper edge 126 and lower edge 128. Grasping edge 130 may be located furthest from continuation edge 108.

In some embodiments, continuation edge 108 may be larger than grasping edge 130. In other embodiments, grasping edge 130 may be larger or approximately the same size as continuation edge 108. In some embodiments, grasping edge 130 may flare. That is, in some embodiments, the distance between upper edge 126 and lower edge 128, or width 136 may be smaller than the size of grasping edge 130. In still further embodiments, the length of continuation edge 108 may be greater than width 136 of extended portion 104. In some embodiments, upper edge 126 and lower edge 128 may flare as extended portion 104 encounters continuation edge 108 as shown in FIG. 1. In other embodiments, the length of continuation edge 108, width 136, and length of grasping edge 130 may all be substantially similar.

In some embodiments, extended portion 104 may be symmetric about line 134. In other embodiments, extended portion 104 may be skewed toward toe edge 114. That is, in some embodiments, more of extended portion 104 may be located toward toe edge 114 than heel edges 116. In other embodiments, extended portion 104 may be skewed toward heel edges 116. That is, in some embodiments, more of extended portion 104 may be located toward heel edges 116 than toe edge 114. In other embodiments, upper edge 126 and lower edge 128 may be shaped such that extended portion 104 is not symmetric about line 134. For example, in some embodiments, upper edge 126 may have an S-shape. In some embodiments, lower edge 128 may have a corresponding S-shape and therefore extended portion 104 may not be symmetric about line 134. In still other embodiments, upper edge 126 and lower edge 128 may have different shapes and designs.

In some embodiments, extended portion 104 may extend away from base portion 102 in various directions. In some embodiments, extended portion 104 may extend from lateral side 16 as shown in FIG. 1. However, in other embodiments, an extended portion may extend from medial side 18. Additionally, in some embodiments, an extended portion may extend in a largely perpendicular manner to base portion 102 and/or continuation edge 108. For example, extended portion 104 of FIG. 1 is largely perpendicular to continuation edge 108. In other embodiments, extended portion 104 may extend at an angle from continuation edge 108.

The length of extended portion 104 may be varied in different embodiments. For example, in some embodiments, length 138 of extended portion 104 may be greater than width 132 of base portion 102. In some embodiments, length 138 may less than width 132 of base portion 102. In some embodiments, length 138 may be double the dimensional distance of width 132. In still further embodiments, length 138 may be greater than double the dimensional distance of width 132. In some embodiments, extended portion 104 may have a greater length than a width. For example, in some embodiments, the distance of length 138 may be greater than the distance of width 136. In other embodiments, extended portion 104 may have different dimensions such that the distance of length 138 may be less than or equal to the distance of width 136.

Figure 2:
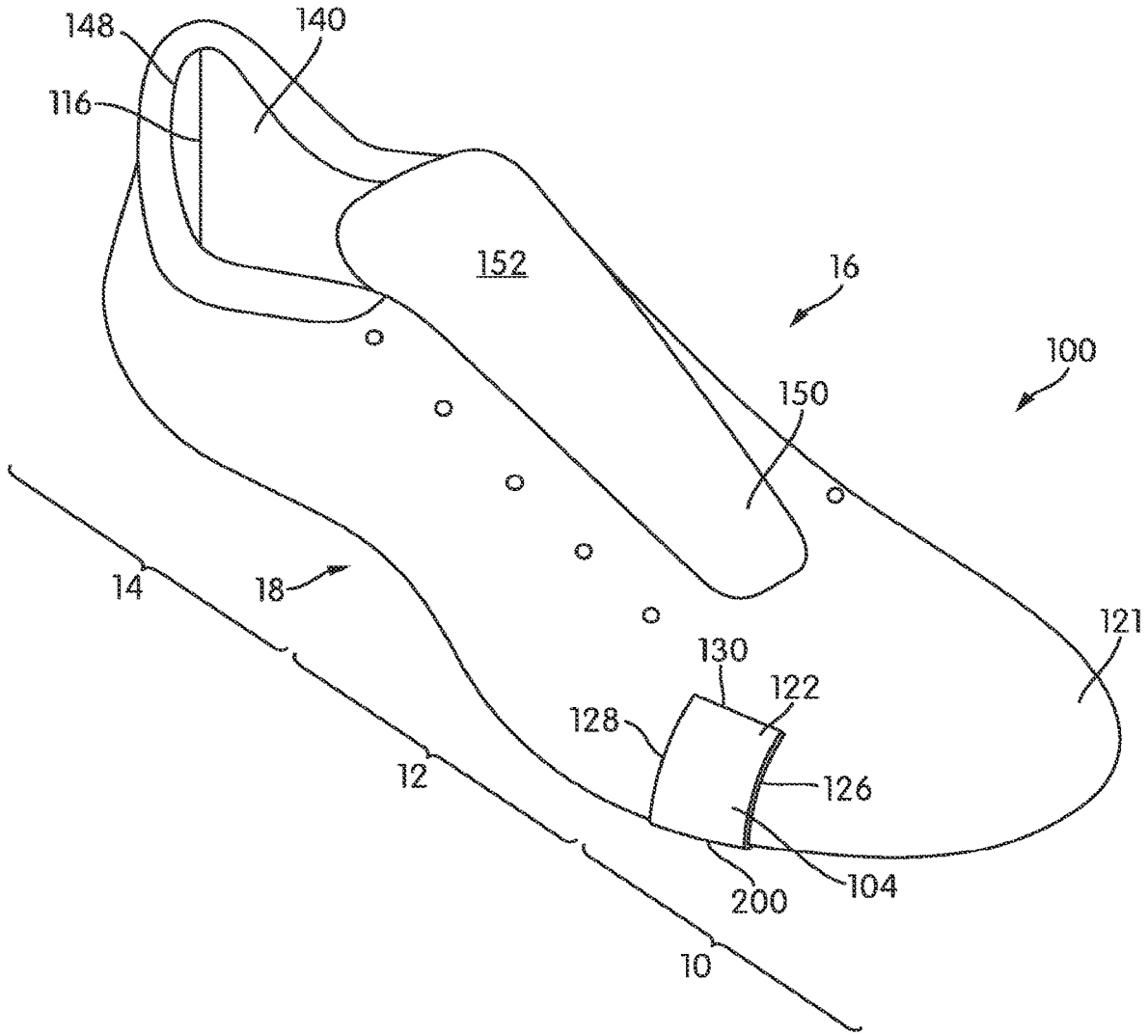
FIG. 2 is an isometric view of an exemplary embodiment of a formed upper component.
Figure 3:
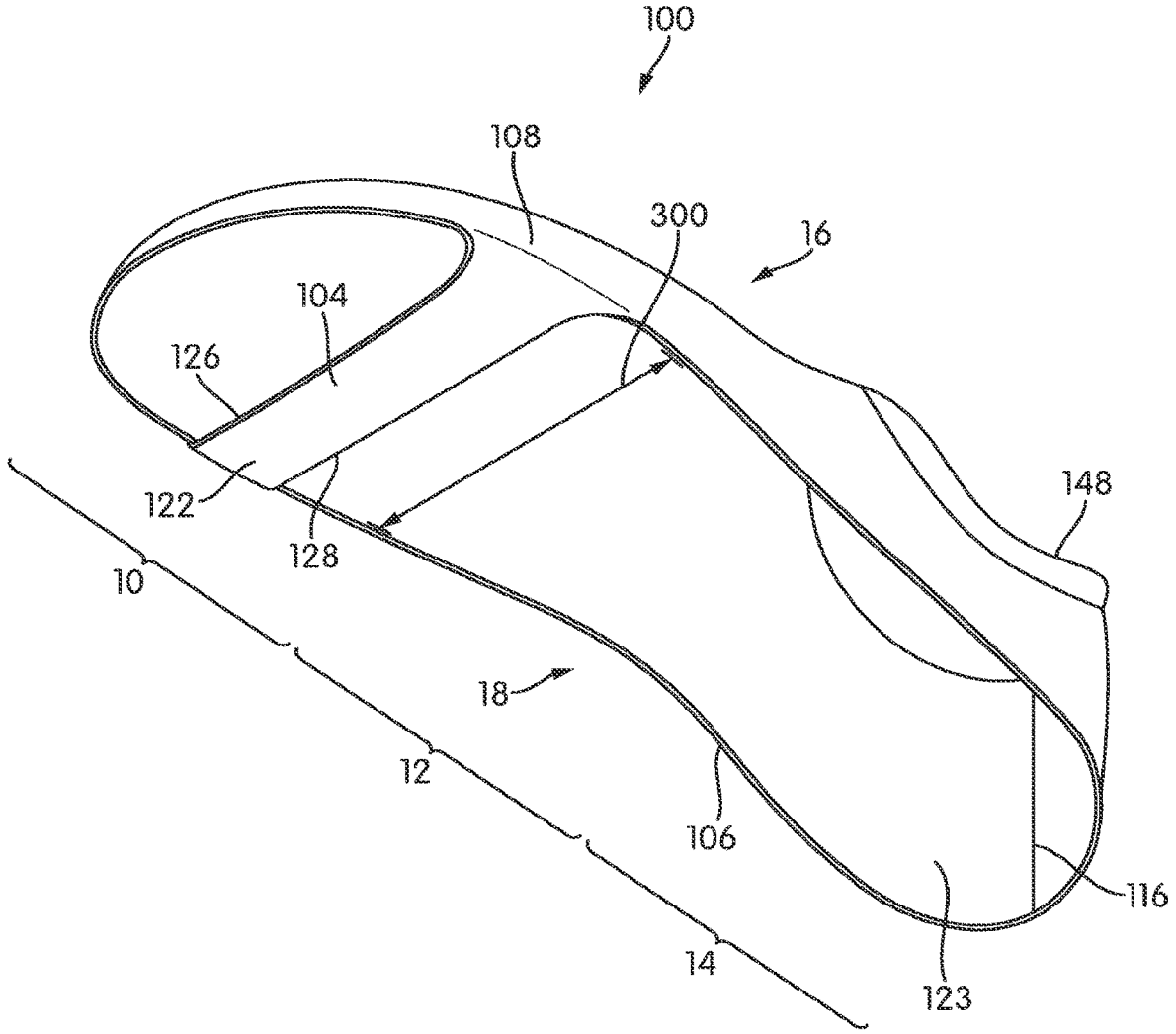
FIG. 3 is an isometric bottom view of an exemplary embodiment of a formed upper component.

Referring to FIGS. 2 and 3, upper component 100 is shown in a partially configured state. In FIGS. 2 and 3, upper component 100 is shown in a generally three-dimensional state, in contrast to upper component 100 as shown in FIG. 1. In FIGS. 2 and 3, upper component 100 is shown without a sole in order to depict the manner in which upper component 100 is configured within an article of footwear. Ankle portion 148 may be formed by the connection of opposite heel edges 116 to one another. As heel edges 116 are connected, a void may be formed between medial side 18 and lateral side 16. In some embodiments, the void may be shaped to accept a foot. It should be recognized that width 300 of upper component 100 in a partially formed state may be a smaller dimensional distance than width 132 of base portion 102 in a two-dimensional state.

As shown, extended portion 104 may wrap below base portion 102. Extended portion 104 may extend from continuation edge 108 toward medial side 18. That is, in some embodiments, extended portion 104 may extend to the opposite side of base portion 102 from which extended portion 104 extends. In some embodiments, extended portion 104 may pass below the void created by base portion 102. That is, in some embodiments, extended portion 104 may pass between base portion 102 and a sole, or the ground or other surface.

In some embodiments, extended portion 104 may extend around a portion of medial side 18 of base portion 102 as shown in FIG. 2. In some embodiments, extended portion 104 may extend beyond perimeter edge 106 located on the opposite side of base portion 102 from which extended portion 104 extends. In some embodiments, extended portion 104 may extend such that a portion of extended portion 104 may be grasped by a user. In other embodiments, extended portion 104 may extend over the top of base portion 102. That is, in some embodiments, extended portion 104 may pass below base portion 102 as well as above base portion 102. In some embodiments, extended portion 104 may therefore extend around base portion 102 or wrap around base portion 102.

In some embodiments, the length of extended portion 104 may be varied. In some embodiments, the length of extended portion 104 may be sufficient to allow extended portion 104 to pass below base portion 102 and extend above base portion 102 as shown in FIGS. 2 and 3. In other embodiments, extended portion 104 may be sufficient in length to wrap multiple times around upper component 100. That is, in some embodiments, extended portion 104 may extend from lateral side 16 under base portion 102 and then extend above base portion 102 on medial side 18. Extended portion 104 may continue to wrap above base portion 102 toward lateral side 16, and extend again below base portion 102 to medial side 18. Extended portion 104 may be sufficient in length to wrap around base portion 102 multiple times. In some embodiments, extended portion 104 may be sufficient in length to wrap along upper component 100 from forefoot region 10 to heel region 14.

Additionally, in some embodiments, the relation of outer surface 121 of base portion 102 to first surface 122 of extended portion 104 may be changed when extended portion 104 is wrapped below base portion 102. As best seen in FIGS. 3 and 4, first surface 122 of extended portion 104 may be facing vertically downward, toward a sole or away from a foot when extended portion 104 is located beneath the void formed by base portion 102. Additionally, second surface 124 of extended portion 104 may be facing vertically upward or toward a foot and inner surface 123 of base portion 102 when extended portion 104 is located beneath the void formed by base portion 102. The orientation of surfaces of extended portion 104, however, changes at wrap edge 200. Therefore, a portion of first surface 122 of extended portion 104 faces away and vertically downward away from base portion 102. Additionally, a portion of first surface 122 faces in substantially the same orientation as outer surface 121 of base portion 102.

Referring to FIGS. 4 and 5, an article of footwear 400, also referred to simply as article 400, is shown utilizing upper component 100. As shown, article 400 includes a sole structure 110. In some embodiments, article 400 may further include a sockliner. In some embodiments, article 400 may include a strobel. Additionally, in some embodiments, article 400 may include lace 154 or other adjustable tightening devices. In other embodiments, article 400 may further include a tongue 152. In some embodiments, sole structure 110 may include a midsole, inner sole and an outsole. In some embodiments, the outsole may include ground engaging devices. In some embodiments, the outsole may include cleats, studs, or other engagement mechanisms.

As shown, sole structure 110 includes an upper surface 404 and a lower surface 406. Upper surface 404 may be adjacent to upper component 100. Additionally, lower surface 406 may be located opposite upper surface 404. In some embodiments, lower surface 406 may generally be located adjacent to the ground or other surface.

In some embodiments, upper component 100 may be secured to sole structure 110. In some embodiments, a strobel may be secured to sole structure 110. In some embodiments, upper component 100 may be secured to a strobel. In some embodiments, upper component 100 may be stitched to the strobel. In other embodiments, upper component 100 may be affixed to the strobel by adhesive. In still further embodiments, upper component 100 may be secured to a strobel by fasteners including tacks and screws. In some embodiments, a strobel may be used to secure upper component 100 to sole structure 110. In some embodiments, the strobel may be secured to sole structure 110 using an adhesive. In other embodiments, the strobel may be secured to sole structure 110 using mechanical features. In some embodiments, the strobel may be secured to sole structure 110 using fasteners. In some embodiments, fasteners may include tacks, screws, nails, or other connection devices.

In some embodiments, extended portion 104 may be located adjacent to sole structure 110. In some embodiments, extended portion 104 may extend from lateral side 16 to medial side 18 of sole structure 110 as depicted in FIG. 4. In other embodiments, an opposite configuration may be utilized. That is, in some embodiments, the extended portion may extend from medial side 18 to lateral side 16.

Figure 6:
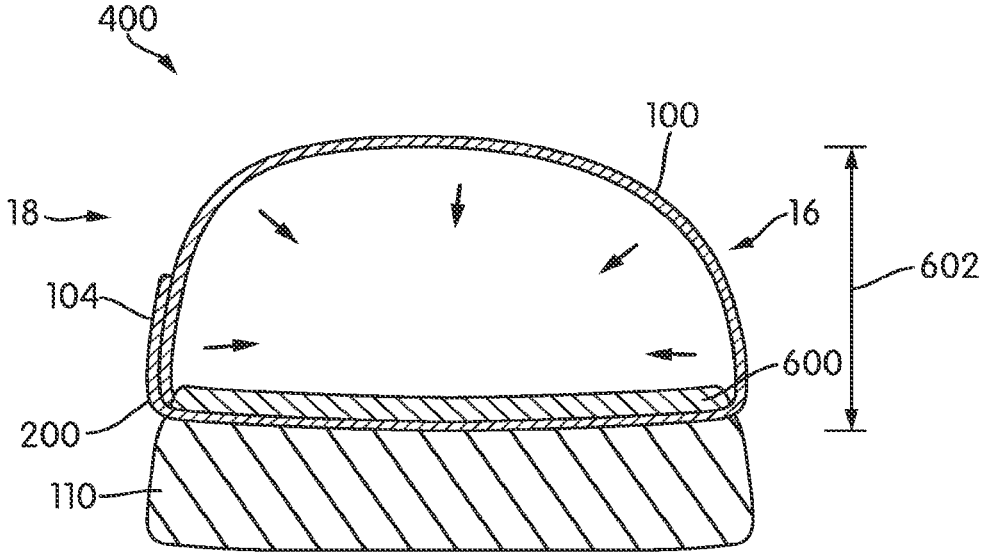
FIG. 6 is a cross-sectional view of an exemplary embodiment of an untightened article.

In some embodiments, extended portion 104 may pass below strobel 600, as shown in FIG. 6. In such configurations, a portion of strobel 600 may be unsecured to sole structure 110 so as to allow extended portion 104 to be able to translate or move when subjected to a tensile force. In some embodiments, a portion of strobel 600 may be unsecured to sole structure 110 in the area of wrap edge 200 so as to allow extended portion 104 to exit from beneath strobel 600 along medial side 18 of article 400.

In some embodiments, extended portion 104 may pass through a portion of sole structure 110. In some embodiments, a groove, channel, or passageway may be formed in sole structure 110 that is able to accommodate extended portion 104. Strobel 600 may be placed over the passageway such that strobel 600 is located adjacent to the plane formed by upper surface 404. That is, strobel 600 may not permanently extend into the passageway that accommodates extended portion 104. Strobel 600 may be able to extend into the passageway (for example, when subjected to a vertical downward force); however, strobel 600 may not be secured to the passageway. Extended portion 104 may enter from the lateral side 16 of the passageway and exit the medial side 18. In other embodiments, a through-hole may be created in sole structure 110 extending between medial side 18 and lateral side 16 and forming a channel or passageway. In some embodiments, extended portion 104 may pass through the hole in sole structure 110. In such embodiments, a user may not be able to feel extended portion 104 in forefoot region 10 of article 400. That is, when using article 400, a bump or raised portion from the thickness of extended portion 104 may not be felt under a foot of a user. This configuration may allow for increased comfort.

In some embodiments, the depth in the vertical direction of the passageway may be such that when extended portion 104 is placed within the passageway, second surface 124 of extended portion 104 lies within the same plane as upper surface 404 of sole structure 110. That is, in some embodiments, sole structure 110 may accommodate extended portion 104 while maintaining a smooth or uniform upper surface 404. In other embodiments, the depth of the passageway may be greater or less such that second surface 124 may be in a separate plane above or below the plane of upper surface 404 of sole structure 110.

In other embodiments, extended portion 104 may pass over upper surface 404 of sole structure 110 in an article that does not include a strobel. In such embodiments, an insert may be placed over upper surface 404 as well as over extended portion 104. In such cases, extended portion 104 may be unsecured to sole structure 110 as extended portion 104 passes adjacent to sole structure 110. That is in some embodiments, extended portion 104 may be able to translate or move along sole structure 110 when subjected to a force.

Figure 7:
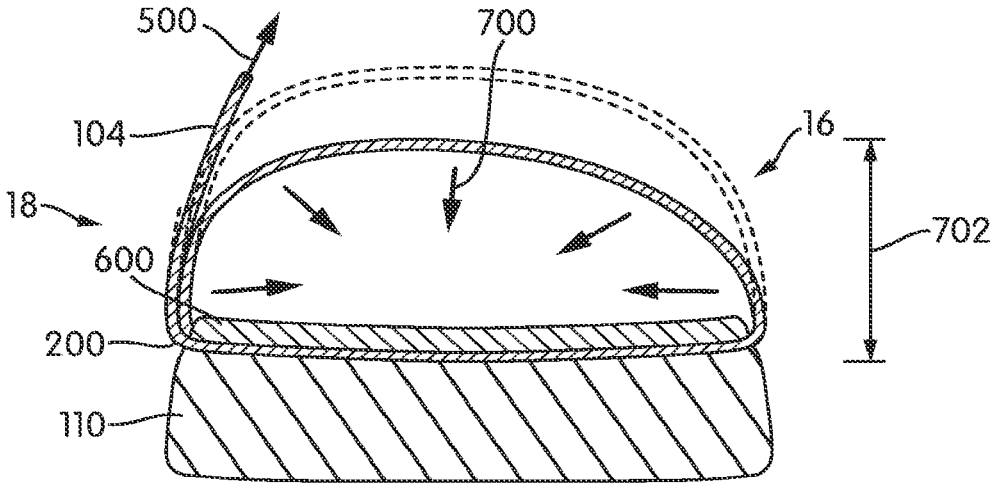
FIG. 7 is a cross-sectional view of an exemplary embodiment of a tightened article.

Referring to FIGS. 5 through 7, article 400 is shown subjected to tensile force 500. In some embodiments, extended portion 104 may be configured to accept a tensile force. As extended portion 104 is tensioned, the shape of upper component 100 may be changed. FIG. 5 depicts article 400 in tensioned and non-tensioned states. The dotted line shows the location of upper component 100 and extended portion 104 when extended portion is not subject to a force. In contrast, the solid line depicts the location of upper component 100 and extended portion 104 when subjected to tensile force 500. As shown in FIG. 5, upper component 100 constricts or compresses when extended portion 104 is subjected to tensile force 500.

Referring to FIGS. 6 and 7, cross-sectional depictions of the forefoot region 10 of article 400 are shown in tensioned and non-tensioned states. As shown in FIG. 7 upper component 100 may constrict or wrap towards the center of the void created by upper component 100 when extended portion 104 is subjected to tensile force 500.

In some embodiments, the height of the void formed by upper component 100 may vary as a tensile force is exerted on extended portion 104. As shown, height 602 represents the distance from sole structure 110 to a vertical portion of upper component 100 when extended portion 104 is not subjected to tensile force 500. Height 702 represents the distance from sole structure 110 to a vertical portion of upper component 100 when extended portion 104 is subjected to tensile force 500. As shown, height 702 may be less than height 602. It should be recognized that the height of upper component 100 may be varied by varying the magnitude of the tensile force applied to extended portion 104. The tensile force exerted upon extended portion 104 may cause a compressive force in the upper as the upper is tightened (see FIGS. 6 and 7).

Referring to FIGS. 6 and 7, extended portion 104 can be secured in a first position (FIG. 6) and a second position (FIG. 7). Extended portion 104 may be variably secured in different ways. For example, in some embodiments, a fastener such as a button or hook may be used. In other embodiments, a lace-type structure may be used. When in the first position, upper component 100 can apply a first amount of compression, and when in a second position upper component 100 can apply a second amount of compression. The amount of compression can be different in each position. The difference in compression values may be represented by the differently sized arrows in the depictions of FIGS. 6 and 7.

Additionally, in some embodiments, extended portion 104 may be configured to be adjustable. In some embodiments, extended portion 104 may be secured in multiple positions thereby exerting different levels of compression or force to upper component 100.

In some embodiments, the compression exerted by upper component 100 may be substantially distributed. That is, the compression of upper component 100 may not be distributed along a single area. For example, in FIG. 7, the compressive forces 700 are shown extending toward a central portion of the void formed by upper component 100. Compressive forces 700 extend from lateral side 16, medial side 18 as well as downward from upper component 100. The location and construction of extended portion 104 may allow for upper component 100 to conform in a wrapping motion, which may allow for a distributed force.

The orientation and design of extended portion 104 may contribute to the distributed compressive forces. In the configuration as shown, relatively vertical tensile force 500 transfers around wrap edge 200, laterally or horizontally toward lateral side 16. Tensile force 500 then is transferred around upper component 100 and back toward medial side 18. The rotational transfer of tensile force 500 through upper component 100 may allow for a relatively even distribution of compressive forces. In this configuration, upper component 100 may wrap or compress fully around upper component 100.

Figure 8:
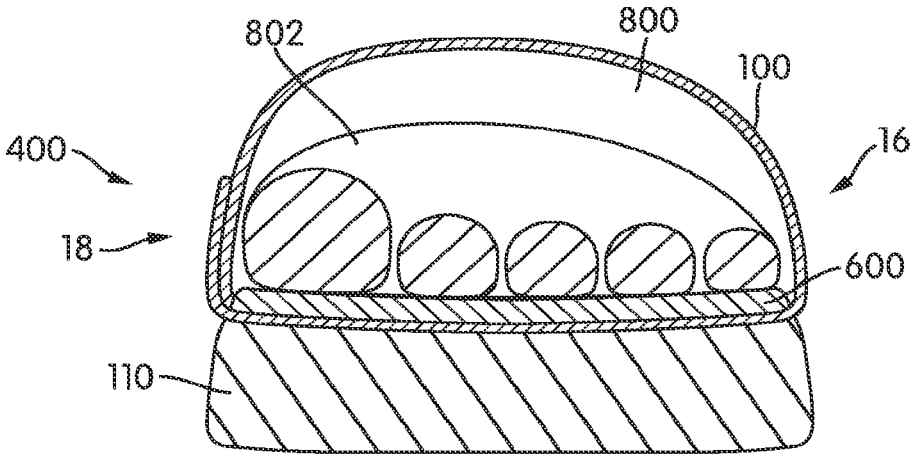
FIG. 8 is a cross-sectional view of an exemplary embodiment of an untightened article of footwear with a foot located within the article of footwear.
Figure 9:
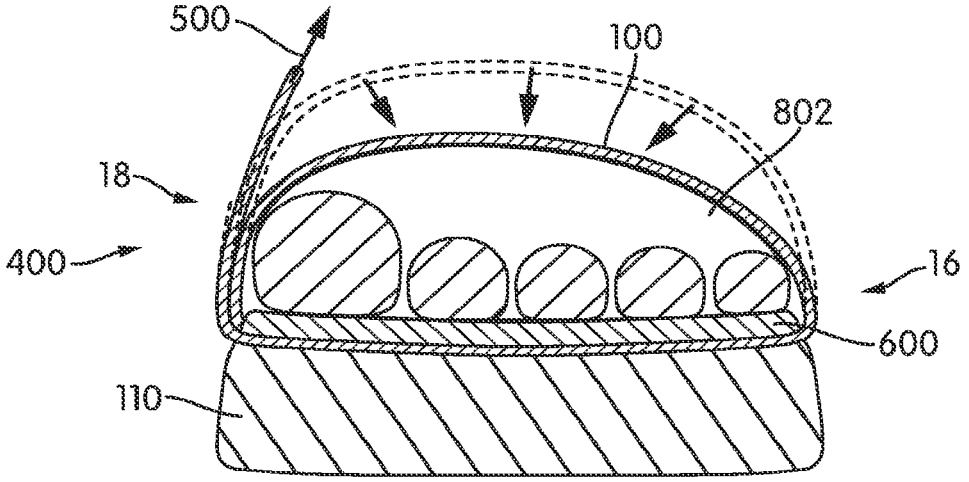
FIG. 9 is a cross-sectional view of an exemplary embodiment of a tightened article of footwear with a foot located within the article of footwear.
Figure 10:
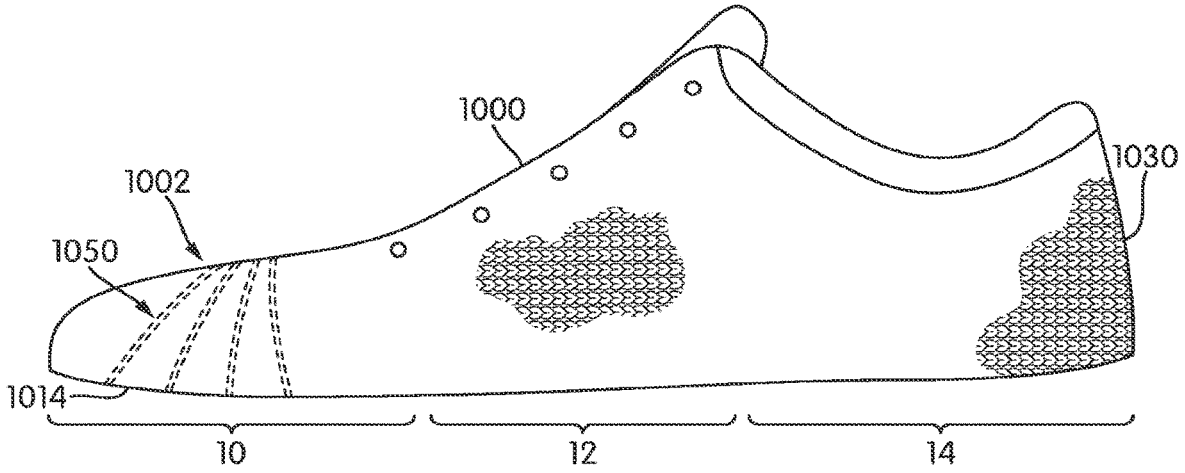
FIG. 10 is a lateral side view of an exemplary embodiment of a formed knitted component.

Referring to FIGS. 8 and 9, a cross-section through forefoot region 10 of article 400 is shown with a foot 802 inserted into the void created by upper component 100 in a tensioned state and in a non-tensioned state. As shown in FIG. 8, a space 800 exists between foot 802 and upper component 100 when extended portion 104 is not subjected to a tensile force. In this state, foot 802 may slide and translate within article 400 without moving article 400. That is, foot 802 may slide without sole structure 110 moving or reacting to the movement of foot 802.

Referring to FIG. 9, extended portion 104 is subjected to a tensile force 500. In some embodiments, upper component 100 may contact foot 802 such that a space does not exist between upper component 100 and foot 802. In other embodiments, a space that is smaller than space 800 may exist between upper component 100 and foot 802. As shown in FIG. 9, extended portion 104 is subjected to a tensile force which tightens upper component 100 around foot 802 and thereby forms compressive forces 700 which may compress upper component 100 to foot 802. In some embodiments, upper component 100 may conform to the shape of foot 802.

In this configuration, article 400 may provide feedback to a user and allow for improved control with the ground. Because upper component 100 may be tightly wrapped or pressed against the foot 802 of a user, article 400 may react with movement of a user. Additionally, the tightened configuration may increase comfort of the wearer due to the distributed force around the forefoot region 10 of foot 802.

FIGS. 10 through 31 disclose a variety of concepts relating to knitted components in articles of footwear. Although the knitted components may be utilized in a variety of products, an article of footwear that incorporates one of the knitted components is disclosed below as an example. In addition to footwear, the knitted components may be utilized in other types of apparel (e.g., shirts, pants, socks, jackets, undergarments), athletic equipment (e.g., golf bags, baseball and football gloves, soccer ball restriction structures), containers (e.g., backpacks, bags), and upholstery for furniture (e.g., chairs, couches, car seats). The knitted components may also be utilized in bed coverings (e.g., sheets, blankets), table coverings, towels, flags, tents, sails, and parachutes. The knitted components may be utilized as technical textiles for industrial purposes, including structures for automotive and aerospace applications, filter materials, medical textiles (e.g. bandages, swabs, implants), geotextiles for reinforcing embankments, agrotextiles for crop protection, and industrial apparel that protects or insulates against heat and radiation. Accordingly, the knitted components and other concepts disclosed herein may be incorporated into a variety of products for both personal and industrial purposes.

Referring to FIGS. 10 through 14, an embodiment of a knitted component 1000 is shown. Knitted component 1000 may be configured similarly to upper component 100. That is, knitted component 1000 may generally be shaped in a similar manner as to knitted component 100 as best seen in FIG. 1. Additionally, in FIGS. 10-14, knitted component 1000 is depicted in a partially formed state without a sole in order to more clearly show the manner in which knitted component 1000 is configured within an article of footwear.

Additionally, knitted component 1000 may be formed of unitary knit construction. As utilized herein, a knitted component (e.g., knitted component 1000) is defined as being formed of "unitary knit construction" when formed as a one-piece element through a knitting process. That is, the knitting process substantially forms the various features and structures of knitted component 1000 without the need for significant additional manufacturing steps or processes. A unitary knit construction may be used to form a knitted component having structures or elements that include one or more courses of yarn, strands, or other knit material that are joined such that the structures or elements include at least one course in common (i.e., sharing a common yarn) and/or include courses that are substantially continuous between each of the structures or elements. With this arrangement, a one-piece element of unitary knit construction is provided.

The primary element of knitted component 1000 is knit element 1030. Knit element 1030 is formed from at least one yarn that is manipulated (e.g., with a knitting machine) to form a plurality of intermeshed loops that define a variety of courses and wales. That is, knit element 1030 has the structure of a knit textile.

In some embodiments, knitted component 1000 may include a tensile element. In some embodiments, knitted component 1000 may include multiple tensile elements 1002. Tensile elements 1002 extend through knit element 1030 and pass between the various loops within knit element 1030. Although tensile elements 1002 generally extend along courses within knit element 1030, tensile elements 1002 may also extend along wales within knit element 1030. Advantages of tensile elements 1002 include providing support, stability, and structure. For example, tensile elements 1002 assist with securing knitted component 1000 around the foot, limits deformation in areas of knitted component 1000 (e.g., imparts stretch-resistance) and operates in connection with lace 154 to enhance the fit of an article of footwear.

In some embodiments, tensile elements 1002 may exit knit element 1030. In other embodiments, tensile elements 1002 may exit knit element 1030 and then re-enter knitted component 1000. In further embodiments, tensile elements 1002 extend through a tube or sheath that is incorporated into knitted component 1000.

In some embodiments, tensile elements 1002 may be incorporated into knitted component 1000. In some embodiments, tensile elements 1002 may be of unitary knit construction with knitted component 1000. The embodiments described herein can make use of the apparatus, structures or methods described in Huffa et al., U.S. Pat. No. 8,839,532, granted on Sep. 23, 2014, entitled "Article of Footwear Incorporating a Knitted Component," the entirety of which is hereby incorporated by reference. In Huffa et al., tensile elements or strands are inlaid into a knitted component to form the inlaid strands.

Figure 11:
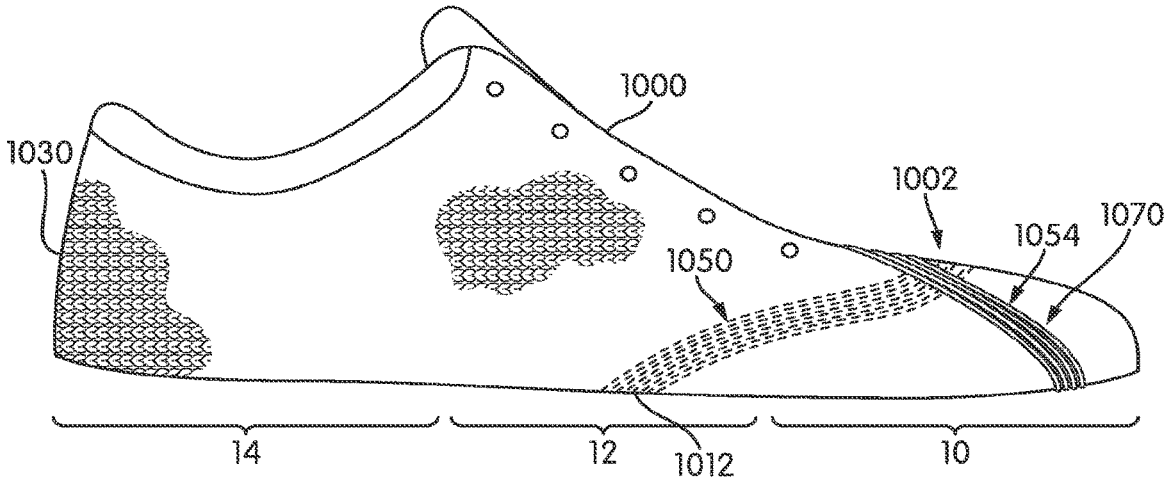
FIG. 11 is a medial side view of an exemplary embodiment of a formed knitted component.
Figure 12:
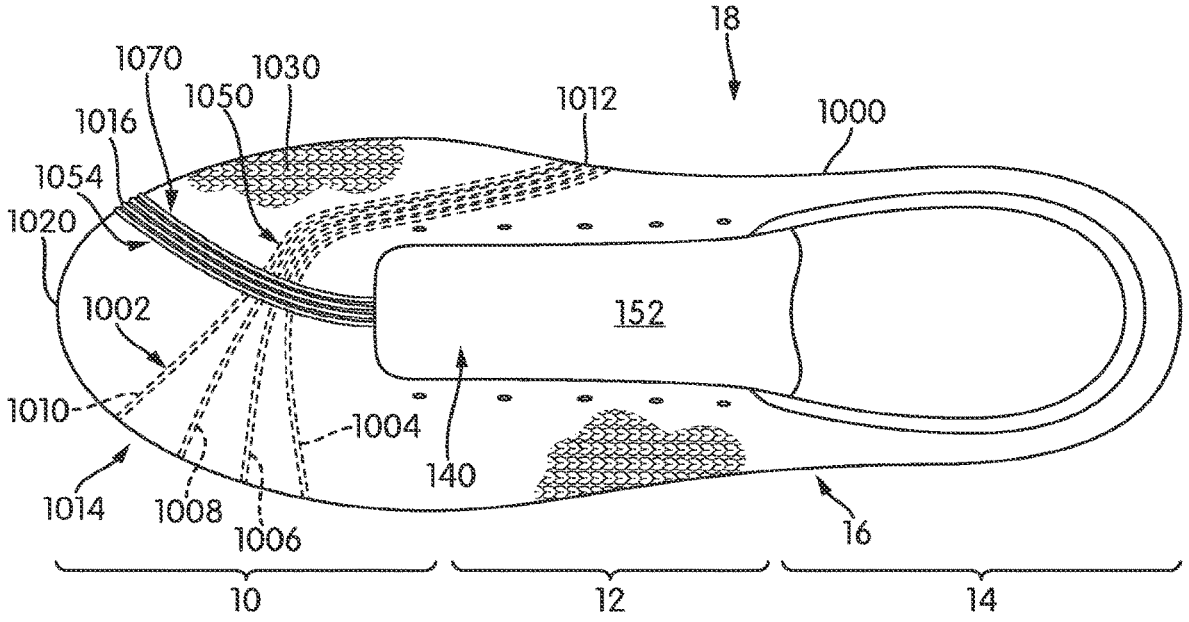
FIG. 12 is a top view of an exemplary embodiment of a formed knitted component.

In some embodiments, tensile elements 1002 may pass through knitted component 1000. In some embodiments, tensile elements 1002 may extend through knitted component 1000 in a close or tight configuration. That is, in some embodiments, tensile elements 1002 may remain parallel and adjacent to one another. For example, tensile elements 1002 shown in FIG. 11 are oriented adjacent to one another. In other embodiments, tensile elements 1002 may extend from one another. As shown in FIG. 12, tensile elements 1002 may splay or spread away from one another in a predetermined fashion. In the embodiment shown in FIG. 12, tensile elements 1002 may begin to splay or spread from one another in a central area of forefoot region 10. In other embodiments, tensile elements 1002 may not splay, or may splay at different locations.

In some embodiments, tensile elements 1002 may extend from side to side of knitted component 1000. In some embodiments, tensile elements 1002 may extend from medial side 18 to lateral side 16. In further embodiments, tensile elements 1002 may wrap around knitted component 1000. That is, tensile elements 1002 may extend underneath knitted component 1000 as well as within knitted component 1002.

In some embodiments, tensile elements 1002 may be secured on a side of knitted component 1000. In some embodiments, tensile elements 1002 may be secured to a strobel. In other embodiments, tensile elements 1002 may be secured to a sole structure. In other embodiments, tensile elements 1002 may be secured to other areas of an article of footwear. For example, tensile elements 1002 may be secured at secure area 1012 on medial side 18. In some embodiments, tensile elements 1002 exit knitted component 1000 and are secured to a strobel or sole. In other embodiments, tensile elements 1002 may remain within knitted component 1000.

In some embodiments, tensile elements 1002 may extend from midfoot region 12 of knitted component 1000. As seen in FIGS. 11 and 12, tensile elements 1002 extend from secure area 1012 located in midfoot region 12 of knitted component 1000. In other embodiments, tensile elements 1002 may extend from other regions of knitted component 1000. Although tensile elements 1002 are secured at secure area 1012 in midfoot region 12, tensile elements 1002 may extend across knitted component 1000 along various paths. That is, strands that are inlaid within knitted component 1000 need not extend directly laterally across knitted component 1000. For example, as shown in FIG. 12, tensile elements 1002 are located in midfoot region 12 on medial side 18, however, as tensile elements 1002 transverse knitted component 1000, tensile elements 1002 may enter forefoot region 10, thereby being located toward toe edge 1020

In some embodiments, tensile elements 1002 may spread apart from one another as tensile elements 1002 extend from medial side 18 to lateral side 16. In some embodiments, tensile elements 1002 may be evenly spaced. Referring to tensile elements 1002 along lateral side 16, tensile elements 1002 may be particularly identified as tensile element 1004, tensile element 1006, tensile element 1008 and tensile element 1010.

In some embodiments, the angle between each of tensile elements 1002 may be the same. For example, in some embodiments, tensile element 1004 may be located approximately 45 degrees from tensile element 1006; tensile element 1006 may be located approximately 45 degrees from tensile element 1008; and tensile element 1008 may be located 45 degrees from tensile element 1010. In other embodiments, the angles between tensile elements 1002 may vary. In still further embodiments, tensile elements 1002 may be oriented such that irregular or inconsistent angles exist between tensile elements 1002. For example, in some embodiments, tensile elements 1002 may include irregular curves.

Figure 13:
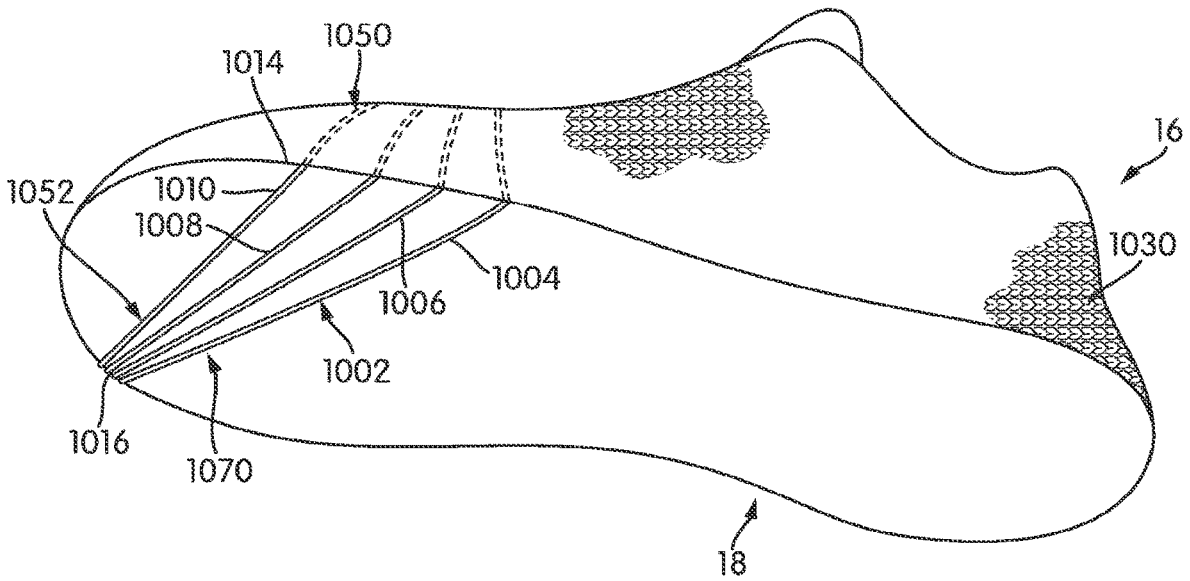
FIG. 13 is a bottom isometric view of an exemplary embodiment of a formed knitted component.
Figure 14:
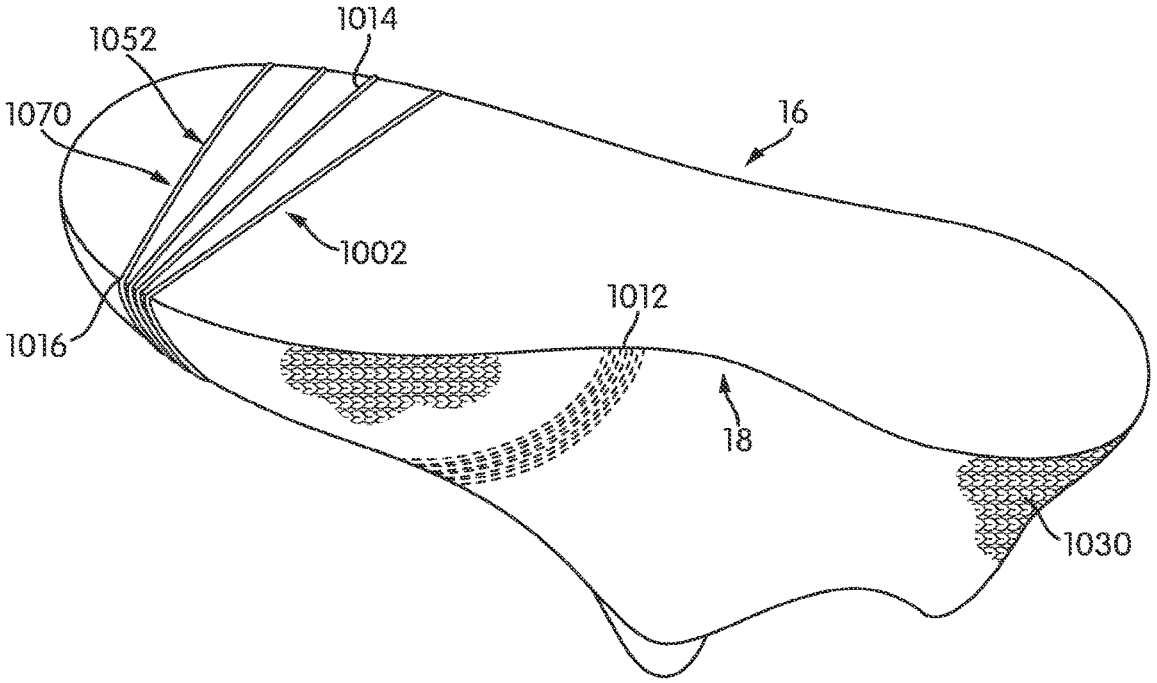
FIG. 14 is a bottom isometric view of an exemplary embodiment of a formed knitted component.

In some embodiments, tensile elements 1002 may extend outside of knitted component 1000. In some embodiments, tensile elements 1002 may extend outside of knitted component 1000 along wrap edge 1014. Wrap edge 1014 may be considered the area in which tensile elements 1002 or a portion of knitted component 1000 begin to extend underneath the void formed by knitted component 1000. The portion of tensile elements 1002 that extend beyond wrap edge 1014 may be considered extended portion 1070. As shown in FIGS. 13 and 14, tensile elements 1002 extend below knitted component 1000.

In some embodiments, tensile elements 1002 may extend underneath knitted component 1000 laterally from lateral side 16 to medial side 18 in an approximate straight path. In other embodiments, tensile elements 1002 may be angled. For example, as shown in FIG. 13, tensile elements 1002 extend from wrap edge 1014 to second wrap edge 1016. In particular tensile element 1010 extends toward second wrap edge 1016 in a largely lateral direction. That is, tensile element 1010 does not form a large angle with respect to knitted component 1000 as tensile element 1010 extends from wrap edge 1014 to second wrap edge 1016. For example, as seen in FIG. 12, tensile element 1010 is located near toe edge 1020 at wrap edge 1014 on lateral side 16 of knitted component 1000. Toe edge 1020 is generally located opposite heel region 14. Additionally, tensile elements 1002 are located near toe edge 1020 at second wrap edge 1016 on lateral side 18. As seen in FIG. 12, tensile elements 1002 may be located laterally across knitted component 1000. Tensile element 1004 may extend under knitted component 1000 at a larger angle than other individual tensile elements of tensile elements 1002. Referring to FIGS. 12 and 13, tensile element 1004 is located further toward heel region 14 on lateral side 16 than is tensile element 1010 on lateral side 16 of knitted component 1000. As tensile element 1004 extends from wrap edge 1014 toward second wrap edge 1016, tensile element 1004 may be oriented at a greater angle than is tensile element 1010 with respect to knitted component 1000.

In some embodiments, tensile elements 1002 may be oriented at various angles as tensile elements 1002 extend from wrap edge 1014 to second wrap edge 1016. It should be recognized that by varying the location of wrap edge 1014 and the location of second wrap edge 1016, that the orientation and angles of tensile elements 1002 may be altered. For example, in some embodiments, second wrap edge 1016 may be located further toward midfoot region 12 than depicted in FIGS. 10-14. In such embodiments, the angle of tensile elements 1002 would be different than as depicted in FIGS. 13 and 14. Likewise, by changing the location of tensile elements 1002 along wrap edge 1014, the angle of tensile elements 1002 would change as tensile elements 1002 extend from wrap edge 1014 to wrap edge 1016.

Tensile elements 1002 may be separated into various portions for ease of description. First portion 1050 may refer to the portions of tensile elements 1002 that extend within knitted component 1000 from secure area 1012 to wrap edge 1014. Second portion 1052 may refer to the portions of tensile elements 1002 that extend below knitted component 1000 from wrap edge 1014 to second wrap edge 1016. Third portion 1054 may refer to the portions of tensile elements 1002 that extend from second wrap edge 1016 and over knitted component 1000. Second portion 1052 and third portion 1054 may also be referred to as extended portion 1070. In some embodiments, third portion 1054 may extend toward throat area 140.

Additionally, each of first portion 1050, second portion 1052, and third portion 1054 discussed above may not include tensile elements. For example, second portion 1052 and third portion 1054 may be formed from knit element 1030 without a tensile element passing through knit element 1030. Embodiments utilizing tensile elements 1002 are depicted and discussed for ease of reference. It should be recognized, however, that first portion 1050, second portion 1052, and third portion 1054 may be formed from knit element 1030 and likewise extended portion 1070 may also be formed from knit element 1030.

In some embodiments, the number of tensile elements may vary within knitted component 1000. As depicted in FIGS. 10-14 knitted component 1000 includes four lengths of tensile elements. Tensile elements 1002, however, may be a single continuous strand. In other embodiments, tensile elements 1002 may be four independent elements. In other embodiments, a different number of tensile elements may be utilized. For example, in some embodiments, a single tensile element may be used. In other embodiments, multiple tensile elements may be utilized. The number of tensile elements used may therefore be varied in different embodiments.

In some embodiments, the size or diameter of tensile elements 1002 may vary. In some embodiments, tensile elements 1002 may be formed from a variety of materials and may have the configurations of a rope, thread, webbing, cable, yarn, filament, or chain for example. In some embodiments, tensile elements 1002 may be formed from any generally one-dimensional material that may be utilized in a knitting machine or other device that forms knitted component 1000. As utilized with respect to the present Detailed Description, the term "one-dimensional material" or variants thereof is intended to encompass generally elongate materials exhibiting a length that is substantially greater than a width and a thickness. Accordingly, suitable materials for tensile elements 1002 include various filaments, fibers, and yarns that are formed from rayon, nylon, polyester, polyacrylic, silk, cotton, carbon, glass, aramids (e.g., para-aram id fibers and meta-aram id fibers), ultra-high molecular weight polyethylene, and liquid crystal polymer. Additionally, in other embodiments, tensile elements 1002 may be a generally two dimensional material. For example, tensile elements 1002 may be ribbon-shaped or shaped like a flap or flattened lace structure.

Figure 24:
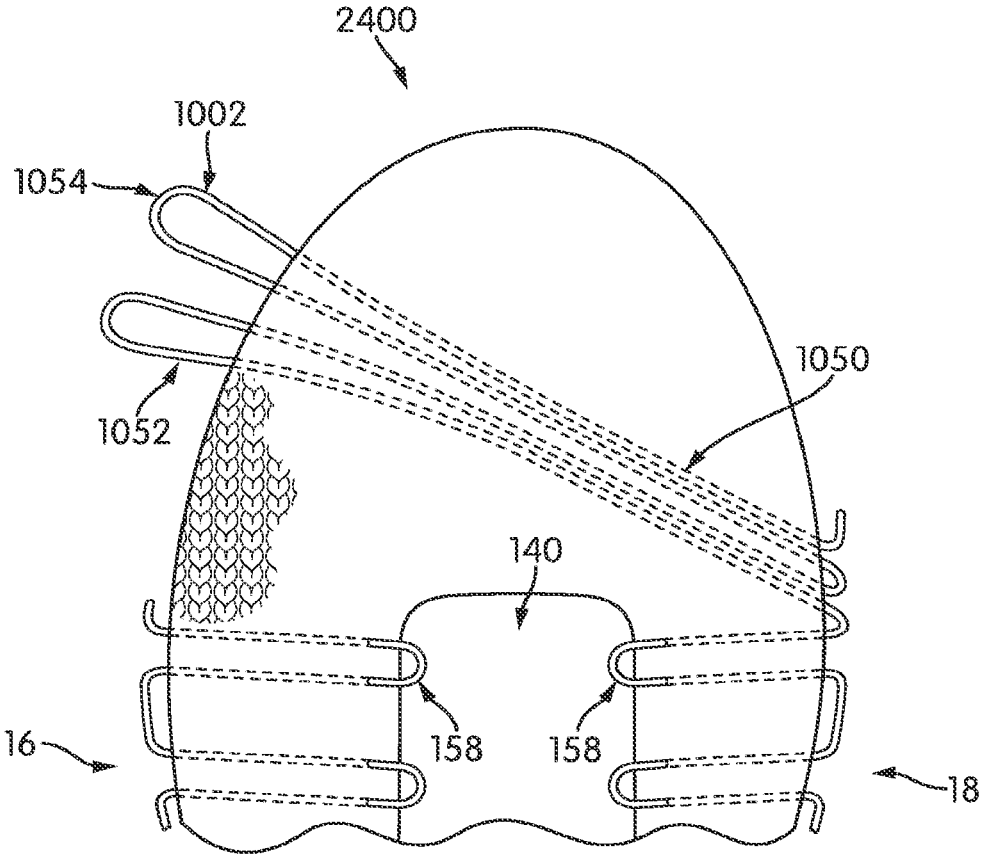
FIG. 24 is a view of an embodiment of a portion of a knitted component.
Figure 25:
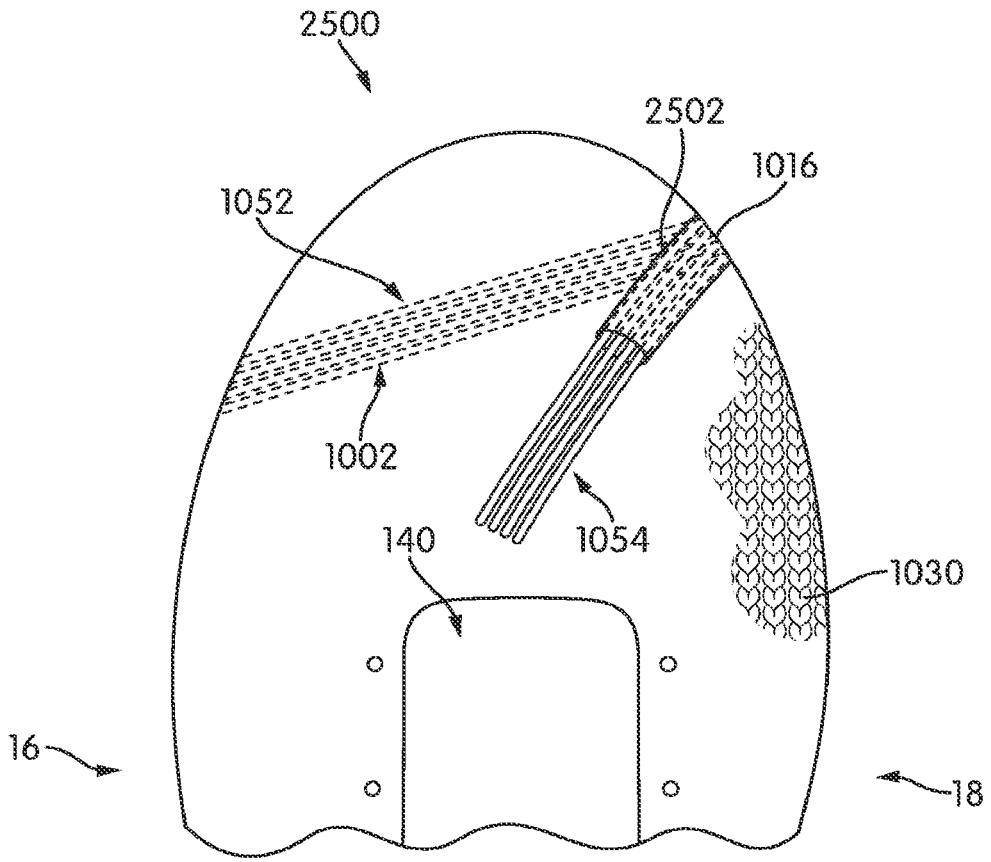
FIG. 25 is a view of an alternate embodiment of a portion of a knitted component.

Additionally, in some embodiments, the location and placement of tensile elements 1002 within knitted component 1000 may alter the function or impact of tensile elements 1002 on knitted component 1000. For example, tensile elements 1002 of first portion 1050 splay or spread apart as tensile elements 1002 extend toward wrap edge 1014. As third portion 1054 is pulled or tensioned, as seen in FIGS. 24 and 25, a tensile force may be distributed over a large portion of lateral side 16 in forefoot region 10. The splaying of tensile elements 1002 may assist in distributing the tensile forces. The distribution of tensile forces may allow for a comfortable feel for a wearer. A distributed force may also diminish high force areas and therefore may diminish high pressure points that are uncomfortable for a user.

Additionally, the location of second wrap edge 1016 may impact the wrapping nature that extended portion 1070 may impart to knitted component 1000. For example, referring to the embodiment shown in FIGS. 10-14, as third portion 1054 is tensioned, knitted component 1000 may wrap or tighten along an area associated with the toes of a user. That is, knitted component 1000 may compress in forefoot region 10 toward toe edge 1020. In other embodiments, second wrap edge 1016 may be located toward midfoot region 12 in an area associated with the metatarsals or ball of a foot. As extended portion 1070 is tensioned in such a configuration, the area of knitted component 1000 than tightens may be associated with the ball of a foot. A knitted component may be formed in various orientations in order to achieve tension, compression, or wrapping in different areas of knitted component 100 associated with various portions of a foot.

In some embodiments, tensile elements 1002 may be exposed under knitted component 1000. That is, in some embodiments, tensile elements 1002 may extend outside of knit element 1030. In such a configuration, tensile elements 1002 may be easily moved and altered to orient tensile elements 1002 in a particular position. In other embodiments, tensile elements 1002 of second portion 1052 may be enclosed by knit element 1030. Various embodiments of second portion 1052 enclosed within knit element 1030 are depicted in FIGS. 1822, and are described in further detail later in this Detailed Description.

Figure 15:
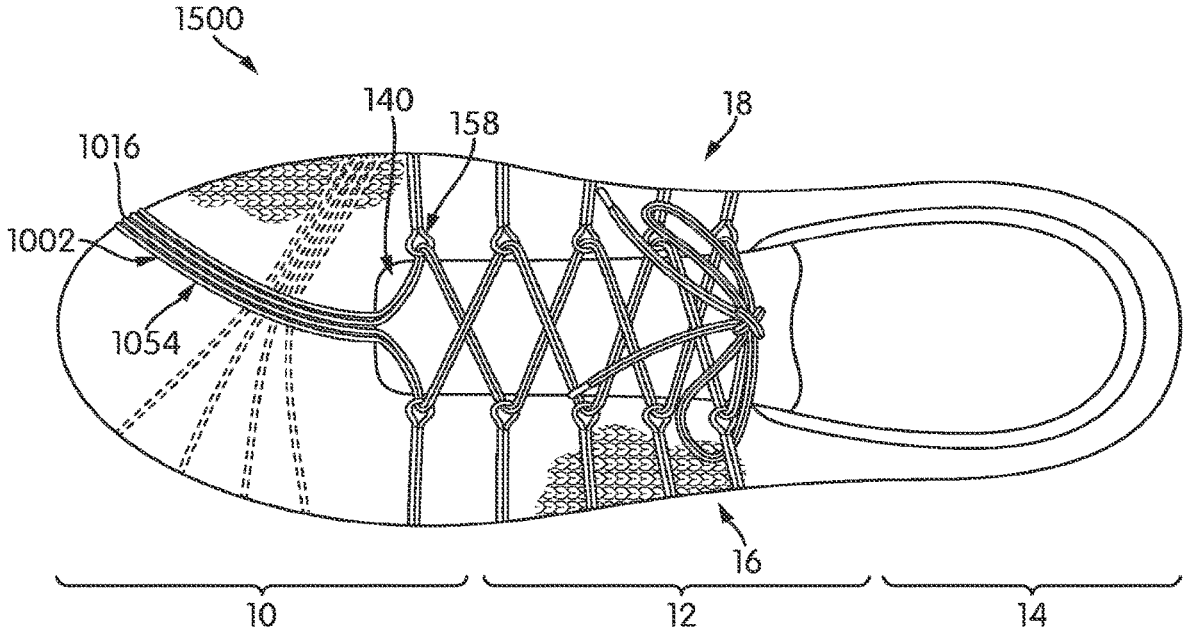
FIG. 15 is a top view of an exemplary embodiment of an article of footwear.
Figure 16:
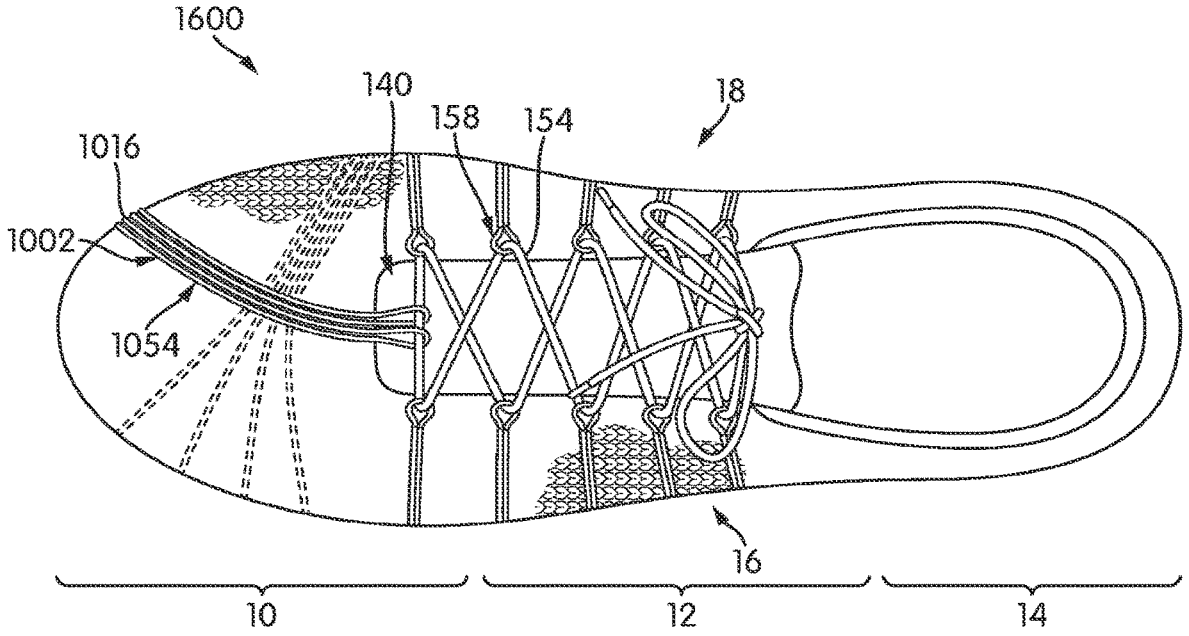
FIG. 16 is a top view of an alternate embodiment of an article of footwear.
Figure 17:
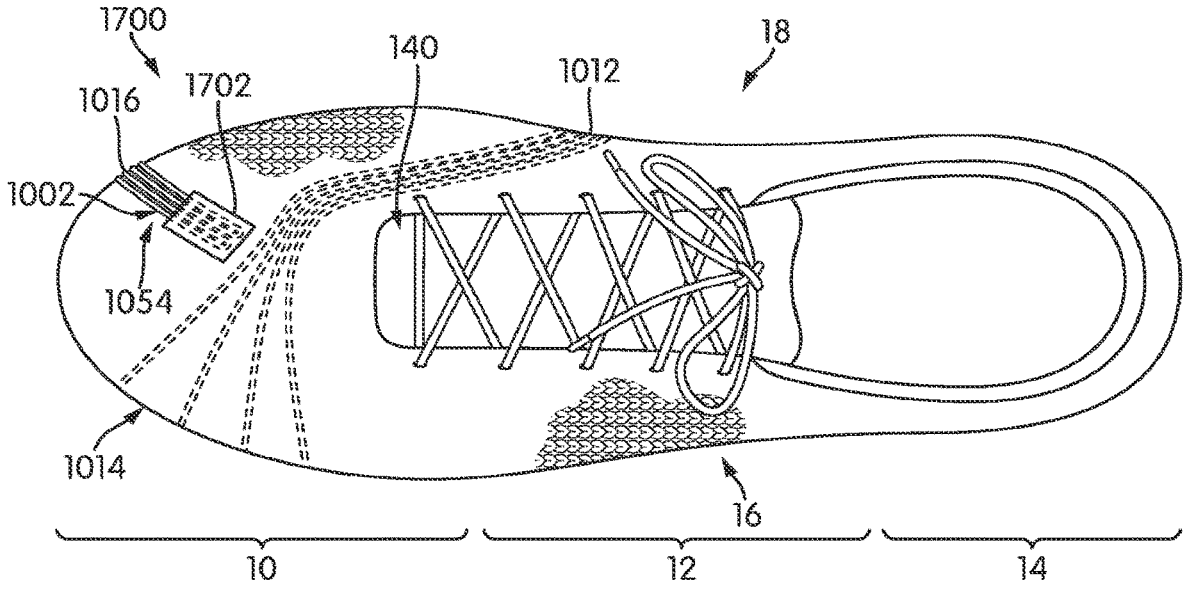
FIG. 17 is a top view of another alternate embodiment of an article of footwear.

Referring to FIGS. 15-17, various embodiments of an article of footwear incorporating different embodiments of third portion 1054 are depicted. Referring in particular to FIG. 15, an embodiment of article of footwear 1500 is shown with third portion 1054 of tensile elements 1002 extending into throat opening 140 of article 1500. Tensile elements 1002 may then be split or organized such that two tensile elements of tensile elements 1002 extend toward medial side 18 and two tensile elements of tensile elements 1002 extend toward lateral side 16 of article 1500. Tensile elements 1002 may then pass through lace loops 158 of article 1500. In this manner, tensile elements 1002 may be used as laces to secure and tighten article 1500 around the foot of a user. Although depicted with two tensile elements of tensile elements 1002 extending in either direction, various embodiments may utilize a different number of tensile elements as well as a different allocation of tensile elements. For example, in some embodiments utilizing four tensile elements, one element may extend toward medial side 18 while three extend toward lateral side 16. Additionally, in some embodiments, some tensile elements of tensile elements 1002 may not extend completely to throat area 140.

In the embodiment shown in FIG. 15, tensile elements 1002 may uniformly tighten article 1500 around the foot of a user. As a user adjusts tensile elements 1002, tensile elements 1002 may tighten article 1500 around throat opening 140 in midfoot region 12. Additionally, tensile elements 1002 may tighten article 1500 in forefoot region 10. As configured, tensile elements 1002 may provide for tightening and compression in various areas of article 1500 by simply adjusting tensile elements 1002 that act as laces in article 1500.

The embodiments described herein can make use of the apparatus, structures or methods described in Dua et al., U.S. Pat. No. 8,490,299 issued on Jul. 23, 2013 entitled "Article of Footwear Having an Upper Incorporating a Knitted Component," the entirety of which is hereby incorporated by reference. For example, portions of article 1500 that enclose lace loops 158 of article 1500 may utilize the apparatus, structures or method of Dua et al. In Dua et al., yarn extends through a portion of a length of a knitted tubular structure in a knitted component. Additionally, various portions of tensile elements 1002 in first portion 1050, second portion 1052 and third portion 1054 may utilize the apparatus, structure or methods described in Dua et al.

Referring in particular to FIG. 16, article 1600 is depicted with an alternate embodiment of third portion 1054 of tensile elements 1002. As shown, third portion 1054 extends from second wrap edge 1016 toward throat opening 140. Tensile elements 1002 extend toward throat opening 140 forming loops within throat opening 140. In some embodiments, a lace 154 may pass through the loops formed by tensile elements 1002. Similarly to article 1500, article 1600 may include lace loops 158 which may accept lace 154. As lace 154 is tightened, tensile elements 1002 may tighten as well. In some embodiments, tensile elements 1002 may therefore tighten in forefoot region 10.

Referring in particular to FIG. 17, article 1700 is depicted with another alternate embodiment of third portion 1054 of tensile elements 1002. As shown, article 1700 includes a grasping pad 1702. Grasping pad 1702 may provide a structure that is easy to grasp by a user. Additionally, grasping pad 1702 may assist in aligning tensile elements 1002 such that the individual tensile elements of tensile elements 1002 do not easily tangle and intertwine with one another.

In some embodiments, grasping pad 1702 may be formed from a knit element. In other embodiments, grasping pad 1702 may be formed from another textile material. In some embodiments, grasping pad 1702 may enclose a portion of tensile elements 1002. In some embodiments, tensile elements 1002 may inlaid within grasping pad 1702 as discussed previously. An embodiment which uses a grasping pad is depicted in FIGS. 24 and 25.

In some embodiments, grasping pad 1702 may be utilized in order to provide various amounts of compression in forefoot region 10 of article 1700. In some embodiments, grasping pad 1702 may be subjected to a tensile force. As grasping pad 1702 is pulled, tensile strands 1002 may tighten and compress an area of forefoot region 10. After the desired amount of compressive force is achieved, grasping pad 1702 may be secured to article 1700.

Grasping pad 1702 may be secured using various methods. For example, grasping pad 1702 may be secured using a button or similar device. Additionally, grasping pad 1702 may include an aperture allowing a lace to pass through the aperture of grasping pad 1702. In further embodiments, grasping pad 1702 may be secured using other techniques.

Additionally, grasping pad 1702 may be secured in various locations. For example, grasping pad 1702 may be secured in forefoot region 10. In other embodiments, grasping pad 1702 may be secured in midfoot region 12. Additionally, grasping pad 1702 may be secured along medial side 18, lateral side 16, or in a central portion of article 1700. Grasping pad 1702 additionally may be secured along various areas of article 1700 depending on the amount of compressive force desired.

Referring to FIGS. 18-22, various embodiments of extended portions including first portion 1050, second portion 1052 and third portion 1054 are depicted in a two-dimensional representation. That is, the portions are depicted as part of an article which has not yet been assembled.

Figure 18:
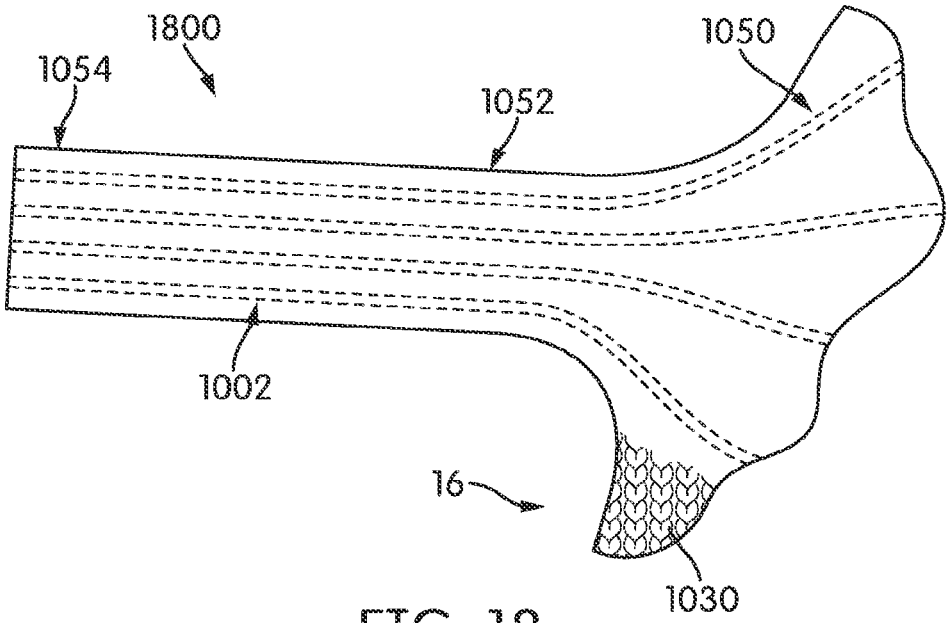
FIG. 18 is a view of an exemplary embodiment of an extended portion of a knitted component.

Referring to FIG. 18, extended portion 1800 is depicted. Extended portion 1800 is a portion of a knitted component. In particular, the lateral side 16 of a knitted component is shown. Extended portion 1800 includes tensile elements 1002 which extend throughout extended portion 1800. As shown, tensile elements 1002 are enclosed a knit element 1030 from first portion 1050 to second portion 1052 to third portion 1054. As such, tensile elements 1002 are generally in a fixed relation to the knit element 1030 in which tensile elements 1002 are located.

Although extended portion 1800 is depicted in largely a rectangular shape, extended portion 1800 may be formed in various shapes. For example, extended portion 1800 may be irregularly shaped or the edges of extended portion 1800 may alter from second portion 1052 to third portion 1054. In some embodiments tensile elements 1002 may not extend through extended portion 1800. That is, in some embodiments, extended portion may be formed from a knit element 1030 that does not include an inlaid tensile element. In other embodiments a portion of tensile elements 1002 may extend beyond the edge of the knitted component formed by knit element 1030.

Figure 19:
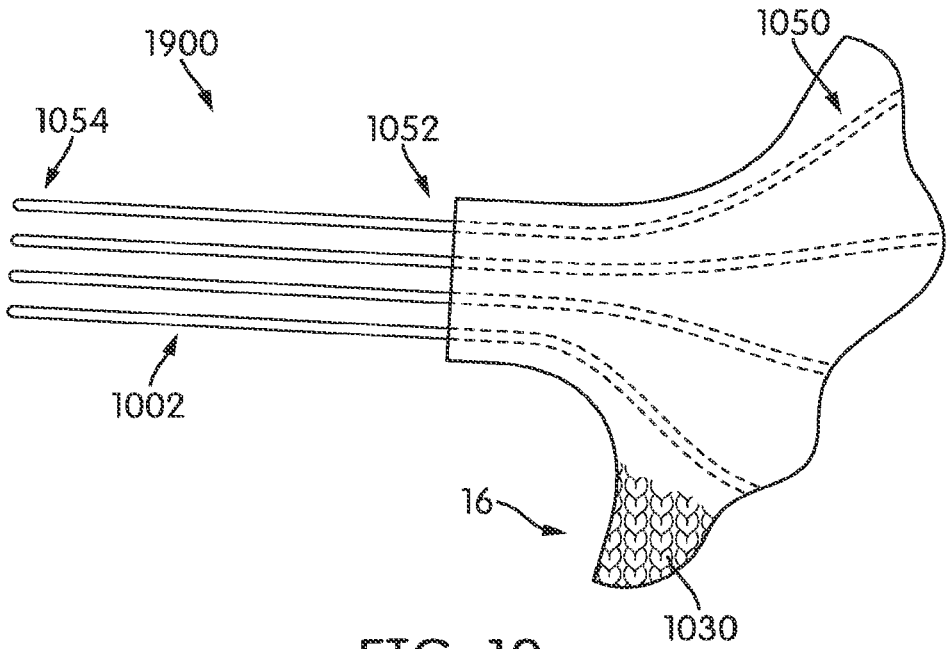
FIG. 19 is a view of an alternate embodiment of an extended portion of a knitted component.

Referring to FIG. 19, an alternate embodiment of an extended portion is depicted. Extended portion 1900 includes tensile elements 1002 a second portion 1052 to a third portion 1054. As shown, part of second portion 1052 of extended portion 1900 includes an inlaid tensile element within a knit element 1030. However, as extended portion 1900 extends toward third portion 1054, tensile elements 1002 exit out of the knit element 1030. In some embodiments, this particular configuration may be used in order to provide stability along wrap edge 1014 while allowing for tensile elements 1002 to be easily moved or manipulated as each tensile element is extended toward second wrap edge 1016. Additionally, tensile elements 1002 may be easily manipulated after wrapping around second wrap edge 1016 for further adjustment.

Figure 20:
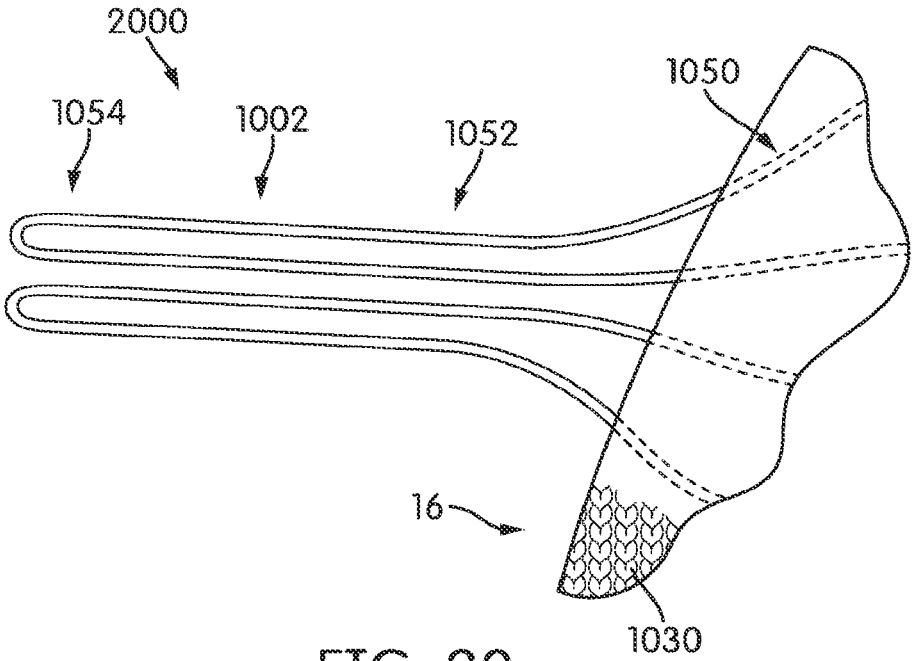
FIG. 20 is a view of an alternate embodiment of an extended portion of a knitted component.

Referring to FIG. 20, another alternate embodiment of an extended portion is depicted. As shown, tensile elements 1002 are located within a knit element 1030 in first portion 1050. As tensile elements 1002 extend toward the edge of the knitted component, however, tensile elements 1002 exit the knitted component. In this configuration, tensile elements 1002 may be located or placed along various paths because tensile elements 1002 are not restricted in second portion 1052 and third portion 1054.

Figure 21:
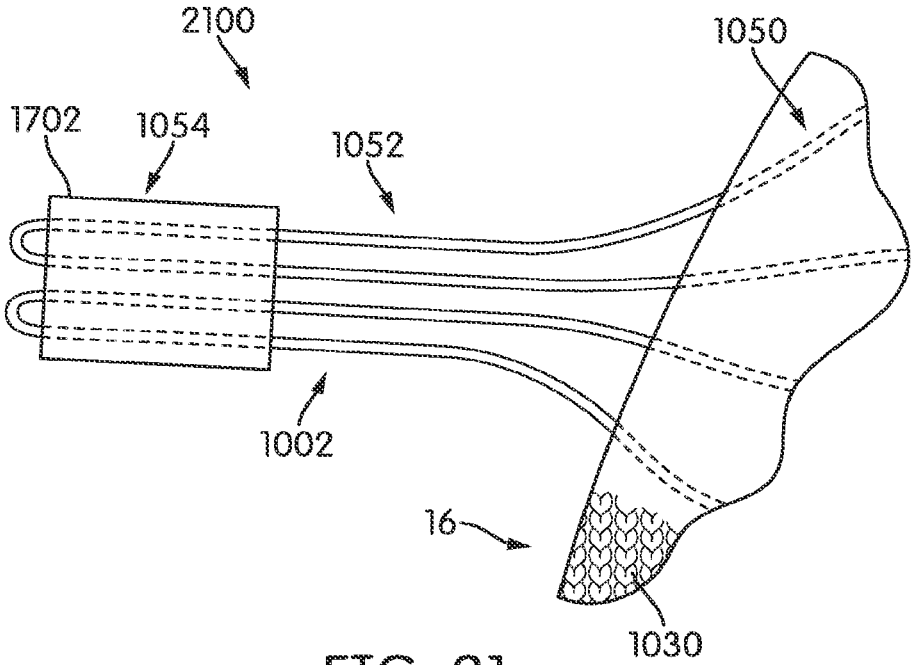
FIG. 21 is a view of an alternate embodiment of an extended portion of a knitted component.

Referring to FIG. 21, another alternate embodiment of an extended portion is depicted. As shown in extended portion 2100, tensile elements 1002 are located within knit element 1030 of a knitted component in first portion 1050. As tensile elements 1002 extend toward the edge of the knitted component, however, tensile elements 1002 exit the knitted component. In second portion 1052 of extended portion 2100, tensile elements 1002 may therefore be located outside of a knit element or knit structure. Tensile elements 1002 may then enter grasping pad 1702.

In some embodiments, tensile elements 1002 may loop within grasping pad 1702. In other embodiments, tensile elements 1002 may terminate within grasping pad 1702. In other embodiments, tensile elements 1002 may extend through grasping pad 1702. As depicted, grasping pad 1702 of extended portion 2100 allows tensile elements 1002 to pass through grasping pad 1702. In this configuration, grasping pad 1702 may be able to slide along tensile elements 1002. Grasping pad 1702 may be able to slide or move from third portion 1054 to second portion 1052. Additionally, in this configuration, tensile elements 1002 may be located or placed along various paths because tensile elements 1002 are not restricted in second portion 1052.

Additionally, in some embodiments, grasping pad 1702 may formed of various configurations. In some embodiments, grasping pad 1702 may be formed of knit construction. In other embodiments, grasping pad 1702 may be formed of woven or non-woven configuration. Further, in some embodiments, tensile elements 1002 may be secured to grasping pad 1702 by stitching, adhesive bonding, thermal bonding, or other techniques.

Figure 22:
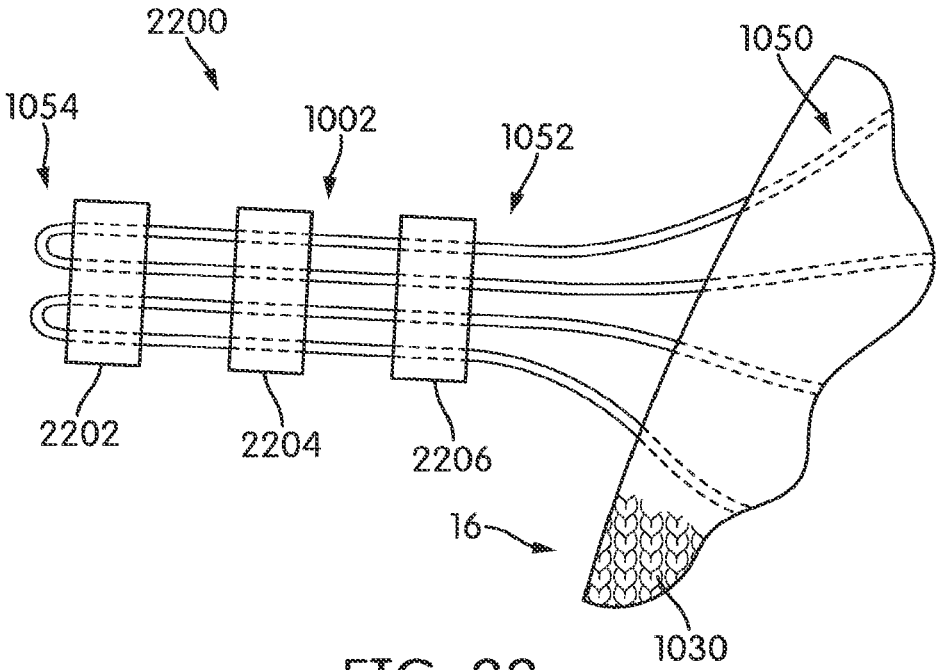
FIG. 22 is a view of an alternate embodiment of an extended portion of a knitted component.

Referring to FIG. 22, another alternate embodiment of an extended portion is depicted. As shown in extended portion 2200, tensile elements 1002 are located within knit element 1030 of a knitted component in first portion 1050. As tensile elements 1002 extend toward the edge of the knitted component, however, tensile elements 1002 exit the knitted component. In second portion 1052 of extended portion 2200, tensile elements 1002 may therefore be located outside of the knitted component.

In some embodiments, multiple grasping pads may be utilized. Grasping pads may be formed in various shapes and sizes. As shown in FIG. 22, grasping pad 2202, grasping pad 2204 and grasping pad 2206 are depicted as approximately the same shape and size. In other embodiments, grasping pad 2202, grasping pad 2204 and grasping pad 2206 may be different sizes and different shapes. For example, a first grasping pad may be triangular in shape, while a second grasping pad may be rectangular in shape. Similarly, a first grasping pad may be larger than a second grasping pad.

Grasping pad 2202, grasping pad 2204 and grasping pad 2206 may be oriented along various portions of extended portion 2200. As depicted, grasping pad 2202, grasping pad 2204 and grasping pad 2206 are approximately evenly spaced along tensile elements 1002. Similar to the configuration shown in FIG. 21, the grasping pads may be movable. Therefore, in some embodiments, the grasping pads may be moved such that grasping pad 2202, grasping pad 2204 and grasping pad 2206 are all located in third portion 1054 of extended portion 2200. In other embodiments, grasping pad 2202, grasping pad 2204 and grasping pad 2206 may all be slid such that all are located in second portion 1052 of extended portion 2200.

In some embodiments, each of grasping pad 2202, grasping pad 2204 and grasping pad 2206 may be secured to an article of footwear at different locations. In some embodiments, when incorporated into an article of footwear, grasping pad 2206 may be located near a toe edge of an article of footwear. In other embodiments, grasping pad 2206 may be positioned near throat opening 140. Each grasping pad may be secured in a particular location to give an athlete a particular fit for an upper depending on the desire of the athlete. Additionally, multiple grasping pads may align tensile elements 1002 as tensile elements 1002 wrap around an upper.

Figure 23:
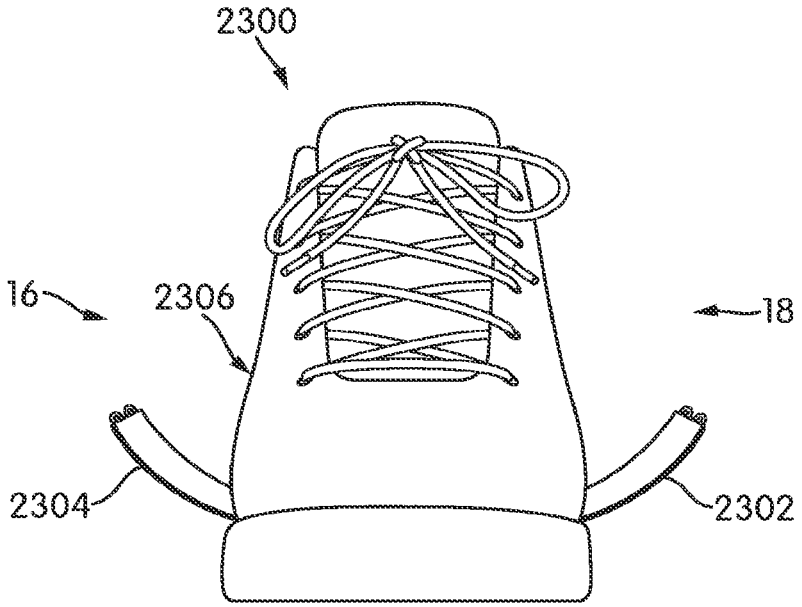
FIG. 23 is a view of an embodiment of an article of footwear incorporating multiple extended portions.

Referring to FIG. 23, the front view of an embodiment of an article of footwear incorporating multiple extended portions is depicted. As depicted the front portion of article 2300 is depicted from the toe area. In this embodiment, article 2300 includes extended portion 2302 and extended portion 2304. Although depicted as a knitted component, it should be recognized that article 2300 could be formed using non-woven and other materials. Extended portion 2304 and extended portion 2302 may be formed in a similar manner as depicted in previous embodiments of this Detailed Description. Extended portion 2302 may extend from lateral side 16 under upper component 2306 to medial side 18. Additionally, extended portion 2304 may extend from medial side 18 under upper component 2306 to lateral side 16. Each of extended portion 2302 and extended portion 2304 may be tensioned individually and secured individually to achieve a desired tension. The use of two extended portions may allow for precise control over the fit of article 2300 around the foot of a user. For example, a user may tension extend portion 2302 to a greater degree than extended portion 2304, allowing for a personalized adjustable fit.

Referring to FIG. 24, an embodiment of a portion of a knitted component is shown. Knitted component 2400 includes tensile elements 1002. In a similar configuration as shown in FIG. 20, tensile elements 1002 exit from knitted component 2400 along the edge of knitted component 2400. In this particular configuration, however, tensile elements 1002 may also form lace loops 158. Tensile elements 1002 extend from medial side 18 toward throat opening 140.

In some embodiments, tensile elements 1002 may be inlaid within knitted component 2400. In other embodiments, tensile elements 1002 may be exposed. As shown, a portion of tensile elements 1002 exits knitted component 2400 near throat opening 140 and forms lace loops 158. In some embodiments, tensile elements 1002 may extend back toward medial side 18 and exit knitted component 2400. Further, tensile elements 1002 may extend across knitted component 2400 to lateral side 16. As such, tensile elements 1002 may form a first portion 1050, a second portion 1052, and a third portion 1054. The portions may correspond to areas of tensile elements 1002 as described in previous embodiments.

In this configuration of knitted component 2400, additional tensioning may be experienced when tensile elements 1002 are subjected to a tensile force. In an assembled article of footwear incorporating knitted component 2400 forefoot region 10 of knitted component 2200 may constrict or constrain as third portion 1054 of tensile elements 1002 is pulled. Additionally, medial side 18 of knitted component 2400 may experience the tensile force. This tensile force may transfer through tensile elements 1002 and form a compressive force (as shown in FIG. 9) and thereby secure a foot within an article of footwear. In some embodiments, knitted component 2400 may further be able to conform to a foot.

Referring to FIG. 25, a portion of knitted component 2500 is depicted with a sheath 2502. Tensile elements 1002 are depicted from second portion 1052 to third portion 1054. As shown, second portion 1052 extends below knitted component 2500 toward second wrap edge 1016. Third portion 1054 of tensile elements 1002 may then extend through sheath 2302.

In some embodiments, sheath 2502 may be a separately added piece. In other embodiments, sheath 2502 may be of unitary construction with knitted component 2500. In some embodiments, sheath 2502 may be formed from knit element 1030. In other embodiments, sheath 2502 may be formed from a different material.

In some embodiments, sheath 2502 may be formed from a largely frictionless material. In some embodiments, sheath 2502 may be configured to allow for tensile elements 1002 to easily pass through sheath 2502. In some embodiments, tensile elements 1002 may be able to slide or translate through sheath 2502. In other embodiments, sheath 2502 may restrict the motion of tensile elements 1002. In embodiments in which sheath 2502 does not largely interfere with the movement of tensile elements 1002, tensile elements 1002 may be easily moved to adjust the amount of compressive force exerted within the forefoot region 10 of an article of footwear. In contrast, in embodiments in which sheath 2502 may constrain tensile elements 1002 from moving, tensile elements 1002 may not need to be secured after tensile elements 1002 are tensioned to a desired amount. In some embodiments, the friction force from sheath 2502 onto tensile elements 1002 may be sufficient to keep tensile elements 1002 from slipping or sliding. In should be recognized that sheath 2502 may be used in previous embodiments discussed in this detailed description.

In some embodiments sheath 2502 may be formed from a hard material. In some embodiments sheath 2502 may be formed from plastic. In other embodiments, sheath 2502 may be formed from a separate textile or other material.

In some embodiments, sheath 2502 may be located in various positions within an article of footwear. As shown in FIG. 23, sheath 2502 is located in forefoot region 10 along medial side 18 of knitted component 2500. In other embodiments, sheath 2502 may be located in midfoot region 12 or heel region 14.

Additionally, sheath 2502 may be oriented at different angles. For example, as depicted in FIG. 25, sheath 2502 angles from medial side 18 generally toward throat opening 140. In other embodiments, sheath 2502 may angle toward lateral side 16, or toward a toe edge of an article. Further, sheath 2502 may be arranged in other orientations.

Figure 26:
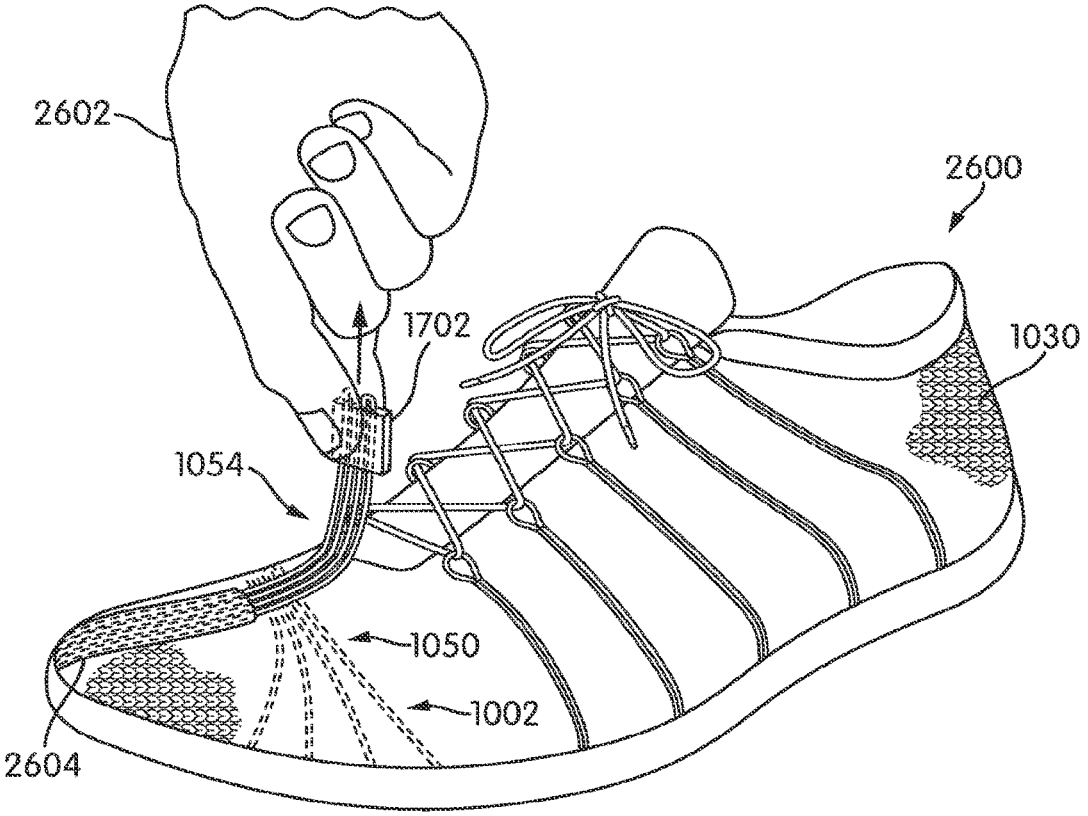
FIG. 26 is an isometric view of an embodiment of an article of footwear being subjected to a force.
Figure 27:
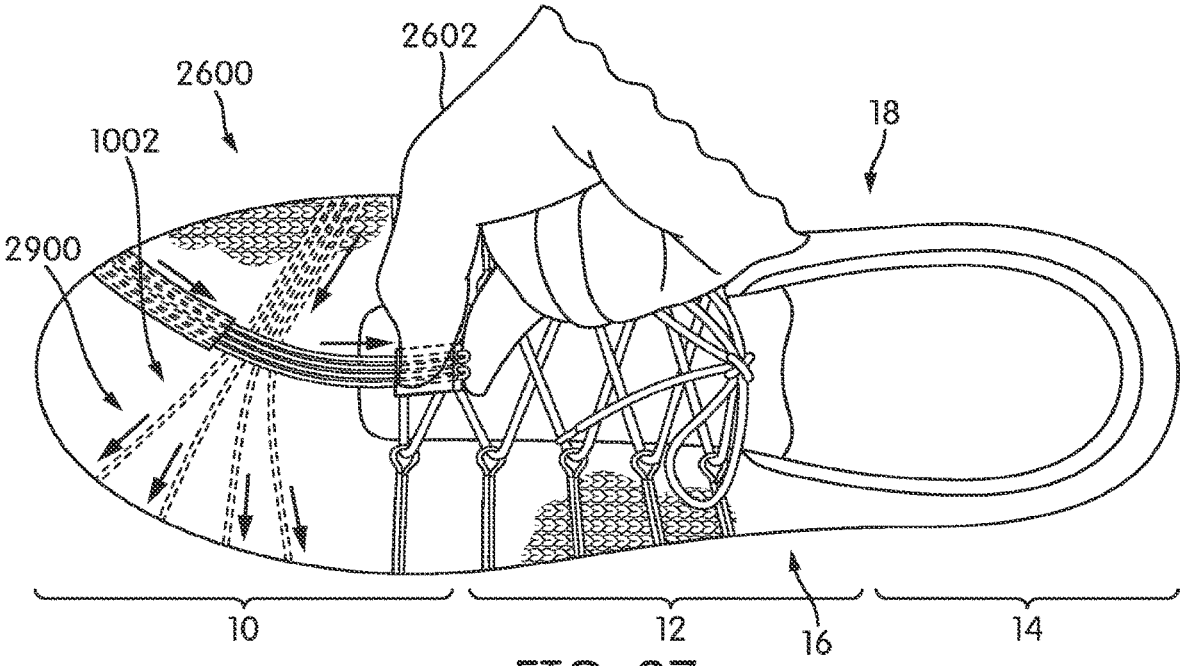
FIG. 27 is a top view of an embodiment of an article of footwear being subjected to a force.

Referring to FIGS. 26 and 27, an article of footwear is shown be subjected to a force. Referring in particular to FIG. 26, an isometric view an article of footwear 2600 is shown. A user 2602 is depicted pulling grasping pad 1702 vertically away from article 2600. As grasping pad 1702 is pulled, tensile forces may transfer throughout tensile elements 1002 in third portion 1054, second portion 1052 and first portion 1050.

In some embodiments, a portion of tensile elements 1002 may be exposed in third portion 1054. As depicted, tensile elements 1002 extend through a knitted strap 2604 in third portion 1054. Tensile elements 1002 further extend out of knitted strap 2604 and then extend into grasping pad 1702. In some embodiments, knitted strap 2604 may extend into second portion 1052. In other embodiments, knitted strap 2604 may be larger such that a greater distance of tensile elements 1002 are located within knitted strap 2604.

As grasping pad 1702 is pulled, tensile elements 1002 may be tightened and subjected to a tensile force. As depicted in FIG. 27, tensile forces 2700 extend throughout tensile elements 1002. The arrows represent the direction in which tensile elements 1002 are pulled and along which direction tensile forces 2700 are directed. As shown, tensile elements 1002 are pulled from lateral side 18 to medial side 16. Additionally, tensile elements 1002 are pulled around forefoot region 10 of article 2600.

Figure 28:
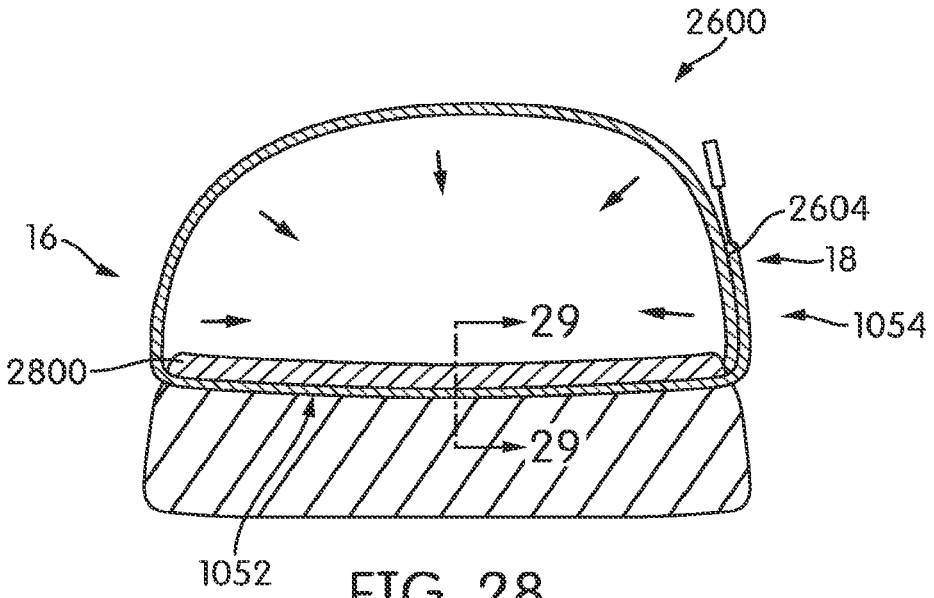
FIG. 28 is a cross-sectional view of an embodiment of an article of footwear in an untightened position.
Figure 29:
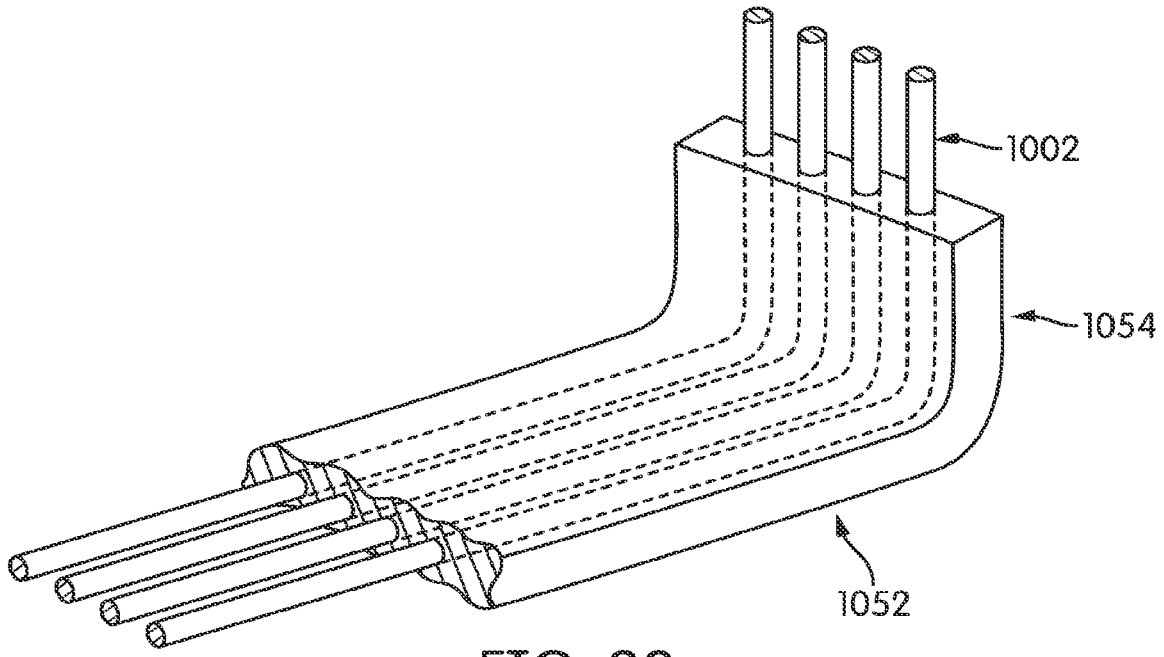
FIG. 29 is an isometric view of an embodiment of an extended portion in an untightened position.

Referring to FIGS. 28 through 31, portions of article 2600 are depicted in tensioned and non-tensioned states. Referring to FIG. 28, a cross-section of article 2600 is depicted in a non-tensioned state, similarly depicted in FIG. 6 in an alternate embodiment. Referring to FIG. 29, an isometric view of a portion of tensile elements 1002 is depicted. The particular portion depicted in FIG. 27 is second portion 1052 and third portion 1054. Second portion 1052 is shown as a portion which extends below strobel 2800. In some embodiments, tensile elements 1002 may be inlaid within a knitted component in second portion 1052. In other embodiments, tensile elements 1002 may be exposed as discussed previously in the Detailed Description.

Figure 30:
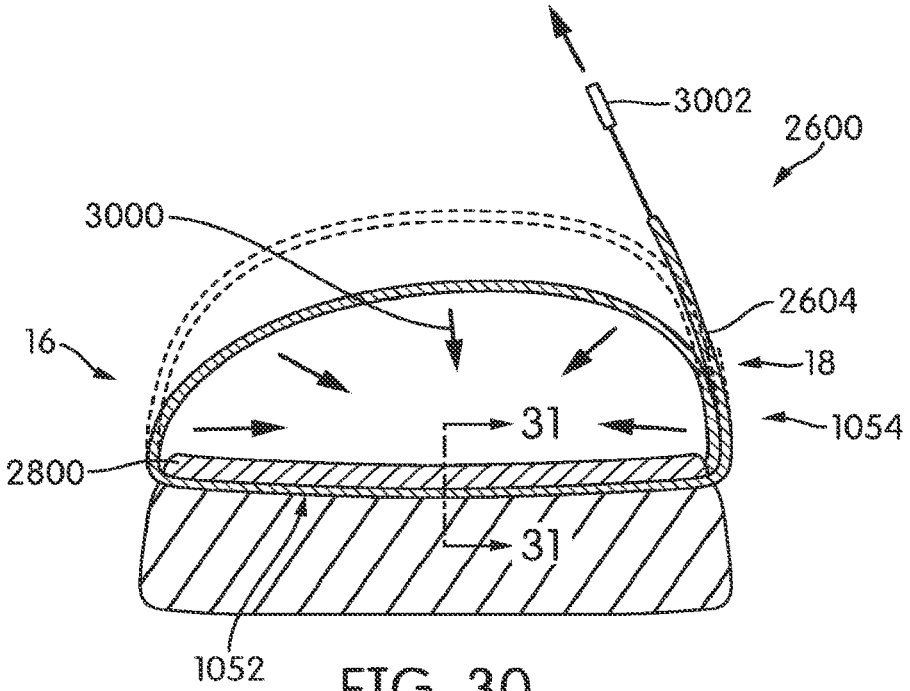
FIG. 30 is a cross-sectional view of an embodiment of an article of footwear in a tightened position.
Figure 31:
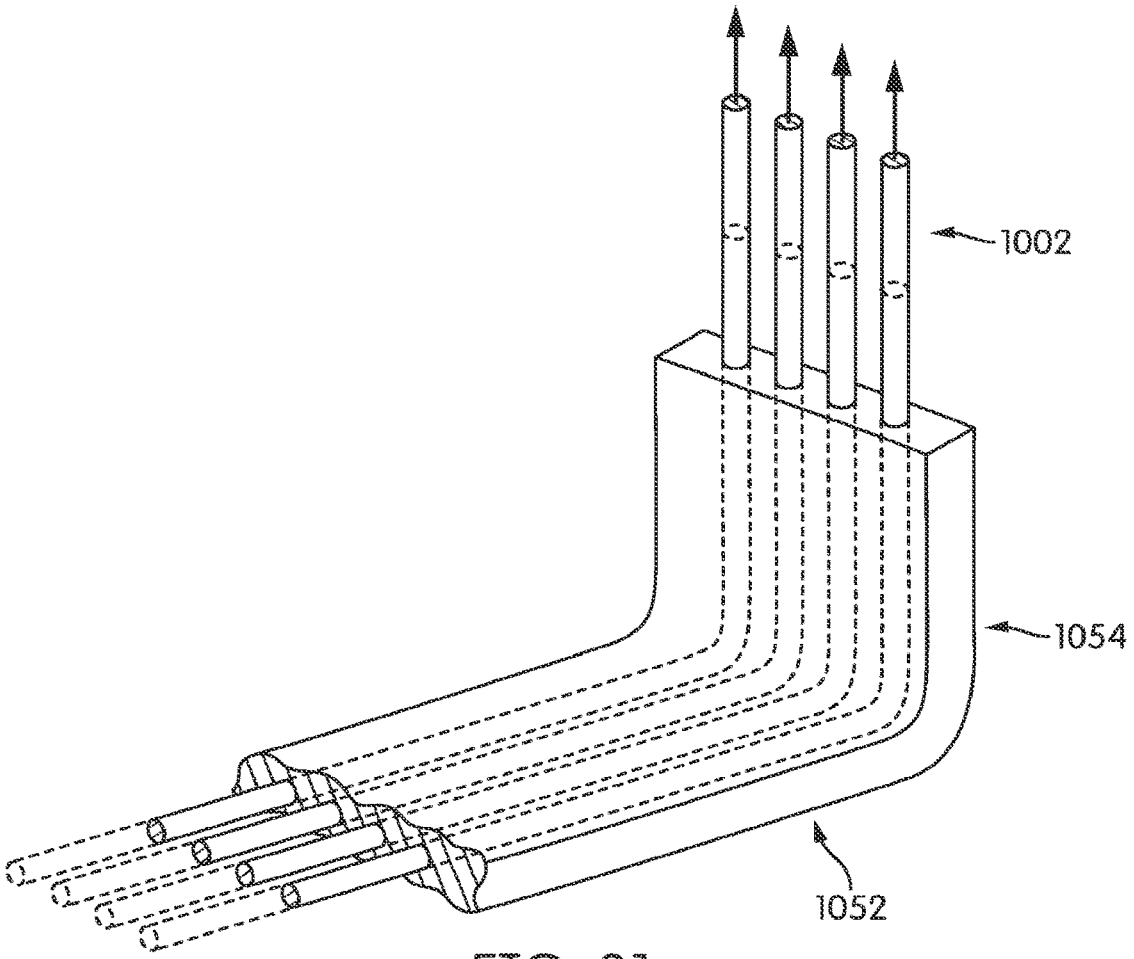
FIG. 31 is an isometric view of an embodiment of an extended portion in a tightened position.

Referring to FIGS. 30 and 31, article 2600 is shown as grasping pad 1702 is subject to tension. Similarly as depicted in FIG. 7, compressive forces 3000 may extend toward the center of the void formed within article 2600.

Referring to FIG. 31, tensile elements 1002 are shown subject to a tensile force 3002. As shown, tensile elements 1002 may extend through knitted strap 2604. As tensile elements 1002 are pulled, tensile elements 1002 may translate through knitted strap 2604.

In some embodiments, knitted strap 2464 and tensile elements 1002 may extend different amounts. In some embodiments, tensile elements 1002 may be able to translate through knitted strap 2604 without pulling or tensioning knitted strap 2604. In some embodiments, the friction between tensile elements 1002 and knitted strap 2604 may be low such as to allow tensile elements 1002 to translate through knitted strap 2604. In such embodiments, tensile elements 1002 may be able to translate within knitted strap 2604 without distorting the shape of knitted strap 2604. In this configuration, knitted strap 2604 may act similarly to sheath 2502. That is, knitted strap 2604 may arrange knit elements 1002 in an organized manner such that the individual knit elements of knit elements 1002 do not intertwine and tangle. Knitted strap 2604 may however, allow for translation of knit elements 1002 through knitted strap 2604. The configuration of this embodiment may allow for a user to tighten knitted strap 2604 with minimal disruption under the foot of a user. This may increase comfort to a user.

In other embodiments, a user may pull knitted strap 2604 so that both tensile elements 1002 and knitted strap 2604 are tensioned to the same degree. That is, in some embodiments, tensile elements 1002 may not freely move through knitted strap 2604. The amount of friction between knitted strap 2604 and tensile elements 1002 may determine the amount that knitted strap 2604 extends when tensile elements 1002 are subjected to a tensile force.

In some embodiments, knitted strap 2604 may be secured along various parts of article 2600. That is, in some embodiments, the knit portion of knitted strap 2604 may be secured. For example, knitted strap 2604 may be sewn, knit, glued or otherwise secured along various areas of article 2600. In some embodiments, knitted strap 2604 may be secured to strobel 2800. In other embodiments, knitted strap 2604 may be secured along various portions of the upper. Although knitted strap 2604 may be secured, tensile elements 1002 may be able to translate through knitted strap 2604. This configuration may allow knitted strap 2604 to be organized and in the same area along article 2600. By locating knitted strap 2604 in a particular location entanglement of knitted strap 2604 with other areas of article 2600 may be reduced. Additionally, by securing knitted strap 2604, entanglement with external objects may be reduced. Further, knitted strap 2604 may be secured for aesthetic purposes. Additionally, by securing knitted strap 2604 to article 2600, knitted strap 2604 may be able to be incorporated into designs of article 2600.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims. As used in the claims, "any of" when referencing the previous claims is intended to mean (i) any one claim, or (ii) any combination of two or more claims referenced.

The invention claimed is:

1. An article of footwear having an upper and a sole structure secured to the upper, the upper comprising a knitted component, the knitted component comprising:

a base portion and an extended portion;

the base portion having a first side and a second side, the extended portion extending from a peripheral edge of the base portion on the first side, the extended portion passing below the base portion from the first side to the second side of the base portion, and the extended portion comprising a grasping pad and a tensile element at least partially incorporated into the grasping pad, the grasping pad configured to be removably secured to the base portion, wherein the tensile element is inlaid within the base portion of the knitted component.

2. The article of footwear according to claim 1, wherein the tensile element extends from the first side of the base portion to the second side of the base portion.

3. The article of footwear according to claim 1, wherein the tensile element is inlaid within the extended portion of the knitted component.

4. The article of footwear according to claim 3, wherein a portion of the extended portion terminates at a free end and the tensile element exits the portion of the extended portion proximate the free end, the tensile element extending freely until terminating within the grasping pad.

5. The article of footwear according to claim 1, wherein the tensile element extends from a midfoot region of the base portion toward a forefoot region of the base portion.

6. The article of footwear according to claim 5, wherein a second tensile element extends from the midfoot region of the base portion to the forefoot region of the base portion.

7. The article of footwear according to claim 1, wherein the extended portion and the base portion comprise a unitary knit construction.

8. The article of footwear according to claim 1, wherein the tensile element comprises a plurality of tensile elements extending adjacent and parallel to one another.

9. An article of footwear having an upper and a sole structure secured to the upper, the upper comprising a knitted component, the knitted component comprising:

a base portion and an extended portion;

the base portion having a first side and a second side, the extended portion extending from a peripheral edge of the base portion on the first side, the extended portion passing below the base portion from the first side to the second side of the base portion, the extended portion comprising a grasping pad and a tensile element at least partially incorporated into the grasping pad, the grasping pad configured to be removably secured to the base portion, the tensile element inlaid within the base portion of the knitted component, and the tensile element extending to a throat area of the upper.

10. The article of footwear according to claim 9, wherein the base portion includes a sheath configured to accept the tensile element.

11. An upper comprising a knitted component, the knitted component comprising:

a base portion and an extended portion;

the base portion having a first side and a second side, the extended portion extending from a peripheral edge on the first side of the base portion, the extended portion passing below the base portion from the first side to the second side, and the extended portion comprising a grasping pad and a tensile element at least partially incorporated into the grasping pad, the grasping pad configured to be removably secured to the base portion, the tensile element inlaid within at least the base portion of the knitted component.

12. The upper according to claim 11, wherein, in a first portion of the extended portion, the tensile element extends within the knitted component, and in a second portion of the extended portion, the tensile element extends outside of the knitted component.

13. The upper according to claim 12 further comprising a plurality of grasping pads located in the second portion of the extended portion, wherein the tensile element extends through the plurality of grasping pads.

14. The upper according to claim 11, wherein the tensile element comprises one of a plurality of inlaid tensile elements.

15. The upper according to claim 11, wherein the extended portion and base portion comprise a unitary knit construction.

16. The article of footwear according to claim 1, wherein the sole structure has an upper surface and a lower surface and the extended portion has a first surface and a second surface, and a portion of the second surface of the extended portion overlays the upper surface of the sole structure.

17. The article of footwear according to claim 1, wherein the tensile element comprises one of a plurality of tensile elements, the plurality of tensile elements in a first portion of the base portion being parallel, the plurality of tensile elements in a second portion of the base portion being splayed.

18. The article of footwear according to claim 1, wherein the tensile element extends through the grasping pad, wherein the grasping pad is configured to slide along the tensile element.

* * * * *